US008534801B2

(12) United States Patent
Yoshino et al.

(10) Patent No.: US 8,534,801 B2
(45) Date of Patent: Sep. 17, 2013

(54) LIQUID EJECTING SYSTEM AND LIQUID ACCOMMODATING CONTAINER

(75) Inventors: Keiichiro Yoshino, Nagano-ken (JP); Hitotoshi Kimura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 353 days.

(21) Appl. No.: 13/024,426

(22) Filed: Feb. 10, 2011

(65) Prior Publication Data

US 2011/0205284 A1 Aug. 25, 2011

(30) Foreign Application Priority Data

Feb. 19, 2010 (JP) ..... 2010-034749
Feb. 23, 2010 (JP) ..... 2010-036946

(51) Int. Cl.
*B41J 2/05* (2006.01)
*B41J 2/175* (2006.01)

(52) U.S. Cl.
USPC ..... 347/59; 347/86

(58) Field of Classification Search
CPC ..... B41J 2/1752; B41J 2/17553
USPC ..... 347/20, 37, 57–59, 86
See application file for complete search history.

(56) References Cited

U.S. PATENT DOCUMENTS 6,634,738 B1 * 10/2003 Shinada et al. ..... 347/86
6,969,136 B1 * 11/2005 Matsumoto et al. ..... 347/7
6,995,861 B1 * 2/2006 Saruta et al. ..... 358/1.9
2003/0051904 A1 3/2003 Aruga

FOREIGN PATENT DOCUMENTS

JP 2003-152297 5/2003

* cited by examiner

*Primary Examiner* — An Do

(57) ABSTRACT

A liquid ejecting system includes: a liquid ejecting head which ejects liquid; a container holder to which a liquid accommodating container main body is detachably attached; a circuit substrate which is movably provided in a side face along an attachment direction of the liquid accommodating container main body; a connector terminal which is attached to a side face of the container holder, which is in parallel with an attachment direction; and a movement member which is provided in the container holder and moves the circuit substrate from a position at which the circuit substrate is separated from the connector terminal to a position at which the circuit substrate makes contact with the connector terminal when the liquid accommodating container main body is attached to the container holder.

10 Claims, 21 Drawing Sheets

LIQUID EJECTING SYSTEM AND LIQUID ACCOMMODATING CONTAINER

BACKGROUND

1. Technical Field

The present invention relates to a liquid ejecting system and a liquid accommodating container.

2. Related Art

There is an existing ink jet printer as one type of a liquid ejecting system (hereinafter, referred to as "printer"). The printer performs printing by ejecting ink (liquid) onto a recording medium arranged on a platen through a plurality of nozzles of a liquid ejecting head (hereinafter, referred to as "head") mounted on a carriage.

In such printer, a plurality of ink cartridges are supported by a cartridge holder in a detachable manner so that ink of each color is supplied to a head. Each ink cartridge has pieces of information such as a type, a color, and a remaining amount of ink accommodated in each ink cartridge and the pieces of information are transmitted and received between each ink cartridge and a printer main body to manage printing operations.

Therefore, a circuit substrate on which a semiconductor storage unit capable of storing the information is mounted is included in each ink cartridge. When the ink cartridges are attached to the cartridge holder, each ink cartridge is electrically connected to a printer main body so as to transmit and receive the information to and from the printer main body.

For example, in JP-A-2003-152297, a projection portion is formed on an attachment portion of a circuit substrate mounted on each ink cartridge at a downstream side in the direction that the ink cartridge is attached to a cartridge holder. The project portion projects in a surface direction of the circuit substrate. Therefore, an end of the circuit substrate is prevented from being made to be into direct contact with connector terminals arranged in the cartridge holder, thereby preventing the end of the circuit substrate from being chipped off and being damaged.

However, in JP-A-2003-152297, when the circuit substrate and the connector terminals are connected to each other in a slide contact manner, if there are dusts on a slide contact path, there is a risk that the dusts adhere to the connector terminals and get into between the circuit substrate and the connector terminals. This causes insufficient contact between the circuit substrate and the connector terminals. Therefore, data cannot be transmitted and received between the semiconductor storage unit mounted on the circuit substrate and the connector terminals. Accordingly, there arises a problem that a printer cannot be normally operated or being the like.

When a projection portion is formed on the attachment portion of the circuit substrate, if the circuit substrate is connected to the connector terminals in a slide contact manner, the surface of the projection portion is rubbed with the connector terminals. Therefore, when the projection portion is formed with a resin material, for example, the material of the projection portion is scratched off. Then, the scratched resin material becomes dusts in a powder form and adheres to the connector terminals. Therefore, there is a risk that the above problem does occur.

SUMMARY

An advantage of some aspects of the invention is to provide a liquid ejecting system and a liquid accommodating container which eliminates an electrical conduction failure between a circuit substrate and a connector terminal and can ensure a normal printing operation.

A liquid ejecting system according to an aspect of the invention includes a liquid ejecting head which ejects liquid, a container holder to which a liquid accommodating container main body is detachably attached, a connector terminal which is attached to a side face of the container holder, which is in parallel with an attachment direction of the liquid accommodating container main body, and a movement member which is provided in the container holder and moves a circuit substrate, which is movably provided on a side face along the attachment direction of the liquid accommodating container main body, from a position at which the circuit substrate is separated from the connector terminal to a position at which the circuit substrate makes contact with the connector terminal when the liquid accommodating container main body is attached to the container holder.

With the liquid ejecting system, when the liquid accommodating container main body is attached to the container holder, the movement of the movement member in the attachment direction makes the circuit substrate move from a position at which the circuit substrate is separated from the connector terminal to a position at which the circuit substrate makes contact with the connector terminal. Therefore, the circuit substrate can be made not to be in contact with any portions until the circuit substrate makes contact with the connector terminal. Therefore, even when there are dusts on a slide contact path as in the existing technique, a problem that the dusts adhere to the connector terminal and get into between the circuit substrate and the connector terminal does not occur. Further, even when a projection portion is formed on an attachment portion of the circuit substrate, a problem that the surface of the projection portion is rubbed with the connector terminal and the material of the projection portion is scratched off does not occur. Accordingly, a liquid ejecting system which eliminates an electrical conduction failure between the circuit substrate and the connector terminal and can ensure a normal printing operation can be provided.

In the above liquid ejecting system, it is preferable that the movement member be a position restriction pin which restricts the position of the liquid accommodating container main body.

With the liquid ejecting system, the movement member moves the circuit substrate from the position at which the circuit substrate is separated from the connector terminal to the position at which the circuit substrate makes contact with the connector terminal and functions as a position restriction pin which restricts the position of the liquid accommodating container main body. That is to say, by adding a function as a movement member to the position restriction pin, the circuit substrate can be moved from the position at which the circuit substrate is separated from the connector terminal to the position at which the circuit substrate makes contact with the connector terminal when the liquid accommodating container main body is attached to the container holder. Accordingly, a movement member is not required to be separately provided in addition to the position restriction pin. This makes it possible to suppress an apparatus from being increased in size.

In the above liquid ejecting system, it is preferable that the position restriction pin include a convex portion which makes contact with the circuit substrate when the liquid accommodating container main body is attached to the container holder, and the liquid accommodating container main body include a position restriction hole into which the position restriction pin is inserted and the position restriction hole include a concave portion corresponding to the convex portion.

With the liquid ejecting system, by providing the convex portion on the position restriction pin, the circuit substrate can be moved from the position at which the circuit substrate is separated from the connector terminal to the position at which the circuit substrate makes contact with the connector terminal when the liquid accommodating container main body is attached to the container holder. Further, the position restriction hole in the liquid accommodating container main body includes the concave portion corresponding to the convex portion. Therefore, the movement member can move along the concave portion. Accordingly, the position restriction pin can be operated as a movement member with a simple configuration.

In the above liquid ejecting system, it is preferable that the circuit substrate rotationally operate from a state where a surface which makes contact with the connector terminal is tilted with respect to the attachment direction to a state where the surface is in parallel with the attachment direction when the liquid accommodating container main body is attached to the container holder.

With the liquid ejecting system, a rotational movement mechanism of the circuit substrate is easily accommodated in the liquid accommodating container main body. To be more specific, a moving space of the circuit substrate can be made smaller in comparison with a case where the circuit substrate is not rotationally operated (for example, a configuration in which the circuit substrate is moved in a slide manner). Therefore, a space for providing a slide mechanism is not required. This makes it possible to suppress an apparatus from being increased in size.

A liquid accommodating container according to another aspect of the invention includes a liquid accommodating container main body which accommodates liquid, and a circuit substrate which is provided on a side face of the liquid accommodating container main body. In the liquid accommodating container, the circuit substrate can move in a direction for being separated from the liquid accommodating container main body when the liquid accommodating container main body is attached to a container holder to which the liquid accommodating container main body is detachably attached.

With the liquid accommodating container, the circuit substrate can move in the direction of being separated from the liquid accommodating container main body when the liquid accommodating container main body is attached to the container holder. Therefore, the circuit substrate can be made not to be in contact with any portions until the circuit substrate moves to a predetermined position (makes contact with the connector terminal). Accordingly, a liquid accommodating container which eliminates an electrical conduction failure between the circuit substrate and the connector terminal and can ensure a normal printing operation, can be provided.

A liquid ejecting apparatus according to still another aspect of the invention includes a liquid ejecting head which ejects liquid, a container holder to which the above liquid accommodating container main body is detachably attached, a connector terminal which is provided on a side face of the container, and a movement member which is provided in the container holder and moves the circuit substrate from a position at which the circuit substrate is separated from the connector terminal to a position at which the circuit substrate makes contact with the connector terminal when the liquid accommodating container main body is attached to the container holder.

With the liquid ejecting apparatus, when the liquid accommodating container main body is attached to the container holder, movement of the movement member in the attachment direction makes the circuit substrate move from a position at which the circuit substrate is separated from the connector terminal to a position at which the circuit substrate makes contact with the connector terminal. Therefore, the circuit substrate can be made not to be in contact with any portions until the circuit substrate makes contact with the connector terminal. Accordingly, a liquid ejecting apparatus which eliminates an electrical conduction failure between the circuit substrate and the connector terminal and can ensure a normal printing operation, can be provided.

A liquid ejecting system according to still another aspect of the invention includes a liquid ejecting head which ejects liquid, a liquid accommodating container main body which accommodates the liquid, a container holder to which the liquid accommodating container main body is detachably attached, a first circuit substrate which is fixed to a side face along an attachment direction of the liquid accommodating container main body, a first connector terminal which is movably provided on a side face of the container holder, which is in parallel with the attachment direction, and a movement member which is provided in the liquid accommodating container main body at a downstream side in the attachment direction and moves the first connector terminal from a position at which the first connector terminal is separated from the first circuit substrate to a position at which the first connector terminal makes contact with the first circuit substrate when the liquid accommodating container main body is attached to the container holder.

With the liquid ejecting system, when the liquid accommodating container main body is attached to the container holder, movement of the movement member in the attachment direction makes the first connector terminal move from a position at which the first connector terminal is separated from the first circuit substrate to a position at which the first connector terminal makes contact with the first circuit substrate. Therefore, the first connector terminal can be made not to be in contact with any portions until the first connector terminal makes contact with the first circuit substrate. Therefore, even when there are dusts on a slide contact path as in the existing technique, a problem that the dusts adhere to the connector terminal and get into between the circuit substrate and the connector terminal does not occur. Further, even when a projection portion is formed on an attachment portion of the circuit substrate, a problem that the surface of the projection portion is rubbed with the connector terminal and the material of the projection portion is scratched off does not occur. Accordingly, a liquid ejecting system which eliminates an electrical conduction failure between the circuit substrate and the connector terminal and can ensure a normal printing operation can be provided.

In the above liquid ejecting system, it is preferable that the first connector terminal rotationally operate from a state where a surface which makes contact with the first circuit substrate is tilted with respect to the attachment direction to a state where the surface is in parallel with the attachment direction when the liquid accommodating container main body is attached to the container holder.

With the liquid ejecting system, a rotational mechanism of the first connector terminal is easily accommodated in the container holder. To be more specific, the moving space of the first connector terminal can be made smaller in comparison with a case where the first connector terminal is not rotationally operated (for example, a configuration in which the first connector terminal is moved in a slide manner). Therefore, a space for providing a slide mechanism is not required. This makes it possible to suppress an apparatus from being increased in size.

In the above liquid ejecting system, it is preferable that the first connector terminal include a plurality of contact portions each of which is arranged at a position which is different from each other in the attachment direction.

With the liquid ejecting system, when the liquid accommodating container main body is attached to the container holder, each of the contact portions makes contact with the first circuit substrate with a time interval. Therefore, before the liquid accommodating container main body is completely attached to the container holder, various pieces of information corresponding to each contact portion can be acquired in advance.

In the above liquid ejecting system, it is preferable that the system further include a second circuit substrate which is fixed to a side face of the container holder, which is in parallel with the attachment direction, and a second connector terminal which is movably provided on a side face of the container holder, which is in parallel with the attachment direction, and electrically connected with the first connector terminal, and the second connector terminal move from a position at which the second connector terminal is separated from the second circuit substrate to a position at which the second connector terminal makes contact with the second circuit substrate when the first connector terminal moves from the position at which the first connector terminal is separated from the first circuit substrate to the position at which the first connector terminal makes contact with the first circuit substrate when the liquid accommodating container main body is attached to the container holder.

With the liquid ejecting system, when the liquid accommodating container main body is attached to the container holder, and when the first connector terminal is moved by the movement of the movement member in the attachment direction, the second connector terminal is moved from a position at which the second connector terminal is separated from the second circuit substrate to a position at which the second connector terminal makes contact with the second circuit substrate. Therefore, the second connector terminal can be made not to be in contact with any portions until the second connector terminal makes contact with the second circuit substrate. Accordingly, a liquid ejecting system which eliminates an electrical conduction failure between the second circuit substrate and the second connector terminal and can ensure a normal printing operation can be provided.

A liquid ejecting apparatus according to still another aspect of the invention includes a liquid ejecting head which ejects liquid, a container holder to which a liquid accommodating container main body accommodating the liquid is detachably attached, a first connector terminal which is provided on a side face of the container holder. In the liquid ejecting apparatus, the first connector terminal can move in the direction for making contact with the liquid accommodating container main body when the liquid accommodating container main body is attached to the container holder.

With the liquid ejecting apparatus, when the liquid accommodating container main body is attached to the container holder, the first connector terminal can move in the direction for making contact with the liquid accommodating container main body. Therefore, the first connector terminal can be made not to be in contact with any portions until the first connector terminal makes contact with the liquid accommodating container main body. Accordingly, a liquid ejecting apparatus which eliminates an electrical conduction failure on the first connector terminal and can ensure a normal printing operation can be provided.

A liquid accommodating container according to still another aspect of the invention includes the above liquid accommodating container main body, a first circuit substrate which is fixed to a side face of the liquid accommodating container main body, and a movement member which is provided in the liquid accommodating container main body at a downstream side in an attachment direction that the liquid accommodating container main body is attached to the container holder and moves the first connector terminal from a position at which the first connector terminal is separated from the first circuit substrate to a position at which the first connector terminal makes contact with the first circuit substrate when the liquid accommodating container main body is attached to the container holder.

With the liquid accommodating container, when the liquid accommodating container main body is attached to the container holder, movement of the movement member in the attachment direction makes the first connector terminal move from a position at which the first connector terminal is separated from the first circuit substrate to a position at which the first connector terminal makes contact with first circuit substrate. Therefore, the first connector terminal can be made not to be in contact with any portions until the first connector terminal makes contact with the first circuit substrate. Accordingly, a liquid accommodating container which eliminates an electrical conduction failure between the first circuit substrate and the first connector terminal and can ensure a normal printing operation can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
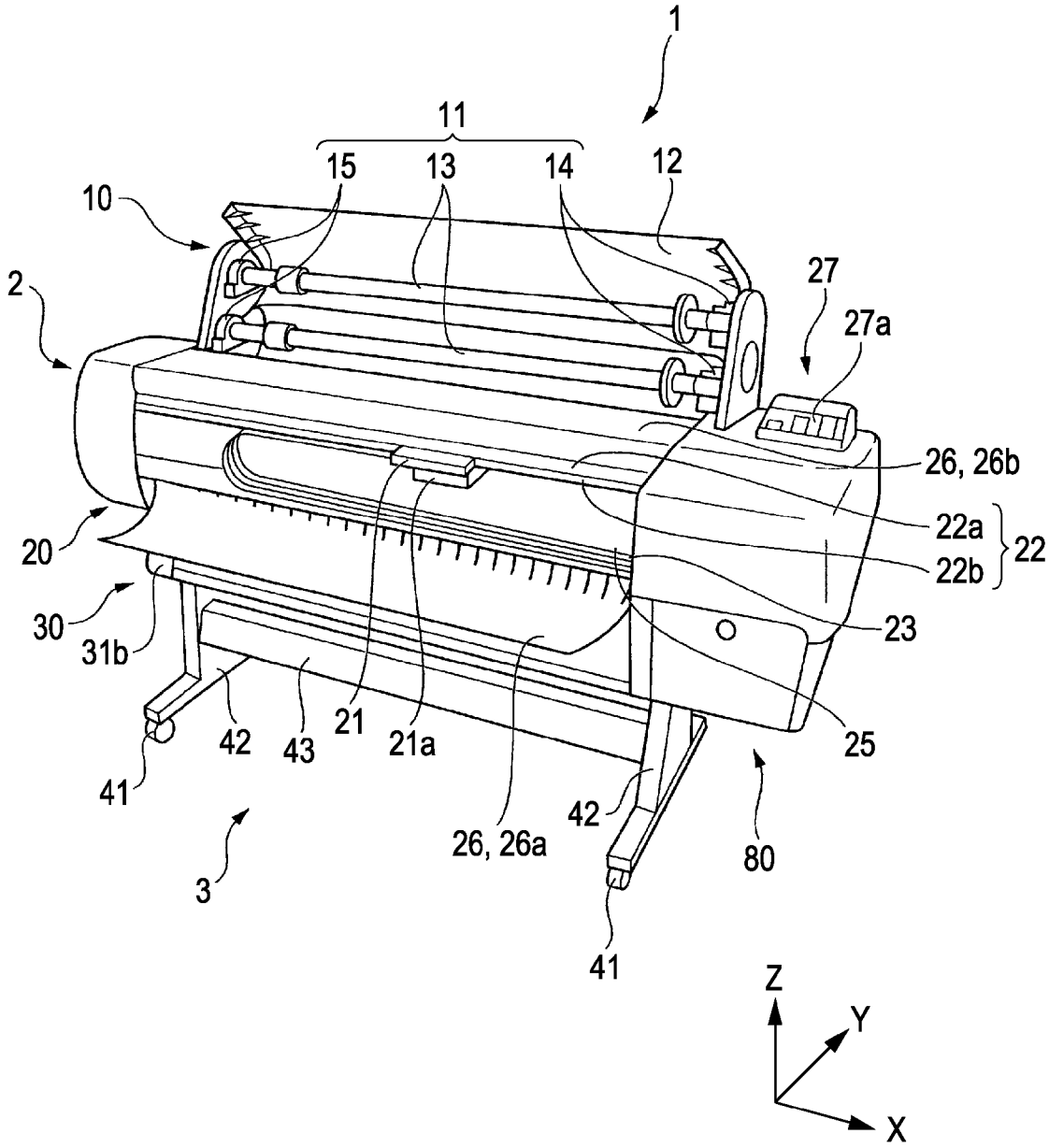
FIG. 1 is a schematic perspective view illustrating a configuration of a liquid ejecting system according to the invention when seen from a front side.

Hereinafter, embodiments of the invention are described with reference to drawings. The embodiments illustrate an aspect of the invention and are not intended to limit the invention. The embodiments can be arbitrarily modified within a range of the technical scope of the invention. In the drawings, scales and numbers of components in each configuration are different from those in a practical configuration in order to make each configuration understood easily.

First Embodiment

Figure 2:
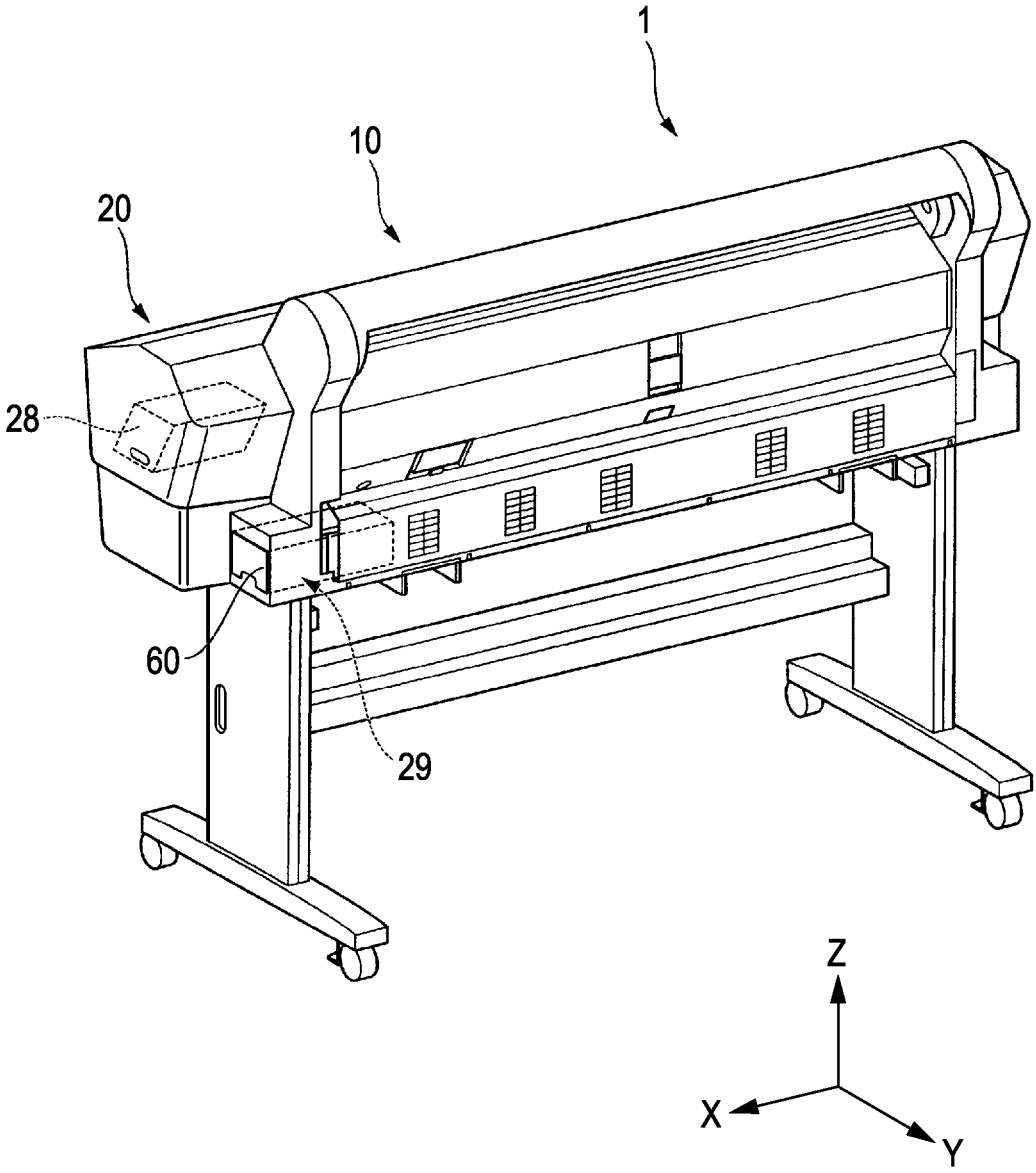
FIG. 2 is a schematic perspective view illustrating a configuration of the liquid ejecting system when seen from a rear side.

FIG. 1 is a schematic perspective view illustrating a configuration of a liquid ejecting system 1 according to an embodiment when seen from a front side. FIG. 2 is a schematic perspective view illustrating a configuration of the liquid ejecting system 1 when seen from a rear side.

Hereinafter, description is given based on an XYZ orthogonal coordinate system as illustrated in FIG. 1. In the XYZ orthogonal coordinate system, the X direction and the Y direction are in parallel with the direction of a plane on which the liquid ejecting system 1 is arranged. The Z direction is orthogonal to the plane on which the liquid ejecting system 1 is arranged. In practice, an XY plane is set to be a plane which is in parallel with a horizontal plane and the Z direction is set to be an upward vertical direction. In the embodiment, an attachment direction in which ink cartridges (liquid accommodating containers) 90 are attached to a cartridge holder (container holder) 80 is set to be the Y direction (−Y direction) and a scanning direction of a liquid ejecting head 21*a* is set to be the X direction.

As illustrated in FIG. 1, the liquid ejecting system 1 is an ink jet large format printer (LFP) which performs recording onto a recording paper having a relatively large size such as A1 size or B1 size (defined by JIS), for example. The liquid ejecting system 1 includes a printer main body (liquid ejecting apparatus) 2 and a leg portion 3. The liquid ejecting system 1 is configured such that the leg portion 3 is detachably fixed to the printer main body 2. Hereinafter, description is given by using an ink jet printer as an example of a liquid ejecting system.

Figure 5A:
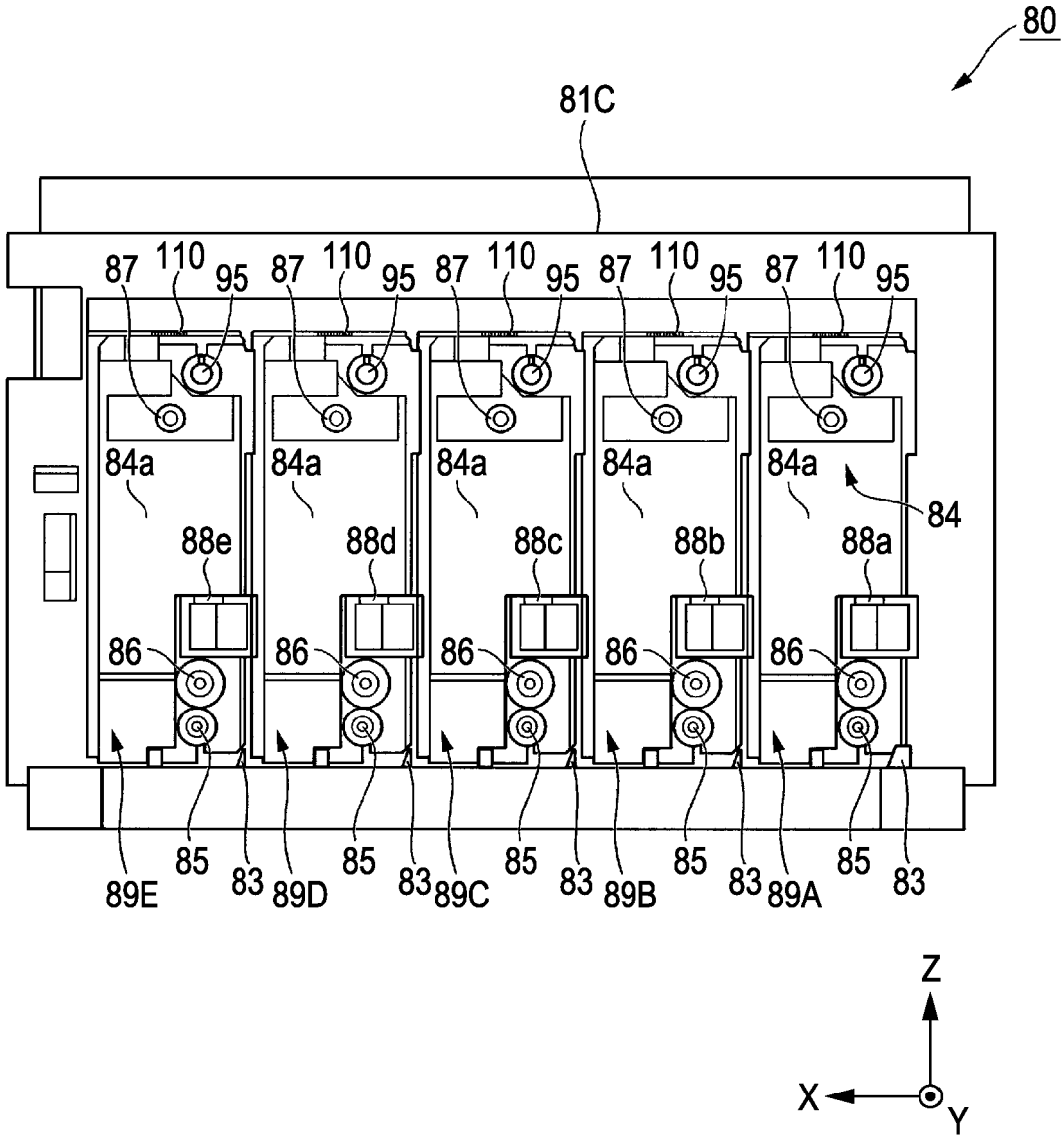
FIGS. 5A and 5B are front views illustrating the container holder.
Figure 5B:
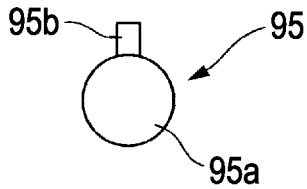

The liquid ejecting system 1 includes a liquid ejecting head 21*a*, ink cartridges 90 (ink cartridge main bodies 91) (see, FIG. 6), a cartridge holder 80, circuit substrates 100 (see, FIG. 6), connector terminals 110, and movement members 95 (see, FIGS. 5A and 5B). The liquid ejecting head 21*a* ejects ink (liquid). The ink cartridges (ink cartridge main bodies 91) accommodate the ink. The ink cartridges 90 are detachably attached to the cartridge holder 80. The circuit substrates 100 are movably provided on side faces of the ink cartridges 90 along an attachment direction in which the ink cartridges 90 are attached to the cartridge holder 80 (hereinafter, referred to as attachment direction). The connector terminals 110 are attached to a side face of the cartridge holder 80, which is in parallel with the attachment direction. The movement members 95 are provided in the cartridge holder 80. Further, the movement members 95 move the circuit substrates 100 from positions at which the circuit substrates 100 are separated from the connector terminals 110 to positions at which the circuit substrates 100 make contact with the connector terminals 110 when the ink cartridges 90 are attached to the cartridge holder 80.

Each ink cartridge 90 includes an ink cartridge main body 91 and the circuit substrate 100 and is used in the liquid ejecting system 1. The printer main body 2 includes the liquid ejecting head 21*a*, the cartridge holder 80, the connector terminals 110, and the movement members 95 and is used in the liquid ejecting system 1. That is to say, the printer main body 2 is an apparatus obtained by removing the ink cartridges 90 from the liquid ejecting system 1.

The printer main body 2 includes a paper feeding unit 10, a recording unit 20 and a paper discharge unit 30. The paper feeding unit 10 is provided above the recording unit 20 so as to project to a rear face side (+Y direction side). A roll paper holder 11 and a roll paper cover 12 are provided in the paper feeding unit 10.

The roll paper holder 11 is a portion on which one roll-form recording paper (hereinafter, referred to as roll paper) is placed and is provided in the paper feeding unit 10. The roll paper holder 11 includes spindle portions 13 and spindle receiving portions 14, 15. The spindle portions 13 are shaft members for holding a roll paper and are extended in the X direction. Roll paper press portions are provided on the spindle portions 13. With the roll paper press portions, a roll paper held by the spindle portions 13 is pressed from both sides so as not to be positionally deviated. The spindle receiving portions 14, 15 are bearing portions which support the spindle portions 13 in a rotatable manner.

The roll paper cover 12 is a swing-type cover member which can be opened and closed and is attached to an outer side of the paper feeding unit 10. The roll paper cover 12 is supported such that the entire cover can be rotationally moved. The roll paper cover 12 can be made in an open state by pressing up a lower portion of the roll paper cover 12 and can be made in a close state by pressing down the lower portion thereof. In FIG. 1, the roll paper cover 12 is in the open state. The roll paper cover 12 covers the roll paper holder 11 when the roll paper cover 12 is in the close state.

The recording unit 20 includes a carriage 21, a carriage movement mechanism 22, a flexible flat cable (FFC) 23, the cartridge holder (container holder) 80, ink tubes 25, a cover member 26, an operation panel 27, a capping mechanism 28, and a waste liquid collecting portion 29. The recording unit 20 further includes a controller 70 (see, FIG. 3), a paper feeding roller (not shown) and the like in addition to the above members. The controller 70 controls operations of each component in the liquid ejecting system 1.

The carriage 21 is a holding member which holds the liquid ejecting head 21*a* and can be moved in the main scanning direction (X direction) by the carriage movement mechanism 22. The liquid ejecting head 21*a* has a liquid ejecting head for black ink, which discharges black ink, and a plurality of liquid ejecting heads for color inks, which discharge ink of each color such as light yellow, yellow, light cyan, cyan, light magenta, magenta, and so on. The liquid ejecting head 21*a* includes pressure generation chambers and nozzle openings which communicate with the pressure generation chambers. Ink is stored in each pressure generation chamber. Ink droplets are ejected onto a roll paper through each nozzle opening by pressurizing each pressure generation chamber, in which ink is stored, at a predetermined pressure.

The carriage movement mechanism 22 has a rail 22*a* and a carriage belt 22*b*. The carriage 21 is coupled to the carriage belt 22*b*. If the carriage belt 22*b* moves in the main scanning direction, the carriage 21 is guided by the rail 22*a* so as to reciprocate in the main scanning direction.

The FFC 23 is a cable which electrically connects the liquid ejecting head 21*a* and the controller 70. One end of the FFC 23 is connected to a connector of the liquid ejecting head 21*a* while the other end thereof is connected to a connector of the controller 70. A recording signal from the controller 70 is transmitted to the liquid ejecting head 21*a* through the FFC 23.

The cartridge holder 80 includes the ink cartridges (see, FIG. 6) therein. The ink cartridges 90 are cartridges which accommodate ink of each color (black, light yellow, yellow, light cyan, cyan, light magenta, magenta and the like) ejected from the liquid ejecting head 21*a*.

The ink tubes 25 are tube members which connect the liquid ejecting head 21*a* and the ink cartridges 90 and are separately provided for each color. An ink pressure-supply mechanism (not shown) is connected to each of the ink tubes 25. Therefore, ink of each color pressurized by the ink pressure-supply mechanism is transmitted to the liquid ejecting head 21*a* from each ink cartridge 90.

The cover member 26 has a front cover 26*a* and an upper cover 26*b*. The front cover 26*a* is provided at a front face of the recording unit 20 so as to cover the carriage 21, the carriage movement mechanism 22, the ink tubes 25, and the like. The front cover 26*a* can be made in an open state by being pressed down and can be made in a close state by being pressed up. In FIG. 1, the front cover 26*a* is in the open state. The upper cover 26*b* is provided at an upper portion of the recording unit 20 so as to cover a paper feeding roller (not shown) and the like. The upper cover 26*b* can be made in an open state by being pressed up and can be made in a close state by being pressed down. In FIG. 1, the upper cover 26*b* is in the close state.

The operation panel 27 is an operation portion for operating the liquid ejecting system 1. The operation panel 27 is provided on a right side (+X direction side) of the upper cover 26*b* of the recording unit 20 in FIG. 1. A display screen 27*a* and various types of buttons (not shown) are arranged on the operation panel 27 so that a user can operate the buttons while checking the display screen. The display screen 27*a* is formed by a liquid crystal attachment, for example. For example, information relating to a printing operation, information relating to exchange of ink, and information relating to an amount of ink supplied to the waste liquid collecting portion 29 are displayed on the display screen 27*a* of the operation panel 27.

The capping mechanism 28 is a maintenance mechanism for preventing viscosity of ink in the vicinity of the nozzle openings of the liquid ejecting head 21*a* from being increased, as illustrated in FIG. 2. A suction mechanism is attached to the capping mechanism 28 so as to suck ink adhered to the nozzle openings.

The waste liquid collecting portion 29 is a portion in which waste liquids are collected. The waste liquids include ink sucked by the capping mechanism 28, ink used when ink is initially filled into the liquid ejecting head 21*a*, washing liquid used when an ink supply flow system up to the liquid ejecting head 21*a* is washed, and the like, for example. The waste liquid collecting portion 29 is provided under the capping mechanism 28 at a rear face side (+Y direction side) of the printer main body 2 as illustrated in FIG. 2. A waste liquid unit 60 is detachably attached to the waste liquid collecting portion 29.

The paper discharge unit 30 is provided at a lower side of the recording unit 20 and has a paper discharge roller (not shown) and a paper discharge guide 31*b*. The paper discharge roller is provided so as to abut against a roll paper. A roll paper is transmitted through the paper discharge roller in the sub scanning direction (direction perpendicular to the main scanning direction). The paper discharge guide 31*b* is provided so as to project to the front side (−Y direction side) of the recording unit 20. A roll paper is guided through the paper discharge guide 31*b* in the sub scanning direction.

The leg portion 3 includes two supporting columns 42 having rollers 41 for moving the liquid ejecting system 1 and a reinforcing bar 43 bridging the supporting columns 42. The recording unit 20 is screwed so as to be fixed to upper portions of the supporting columns 42. A predetermined space is provided between the supporting columns 42 such that a paper reception attachment is arranged. The paper reception attachment receives a roll paper discharged from the paper discharge unit 30.

Figure 3:
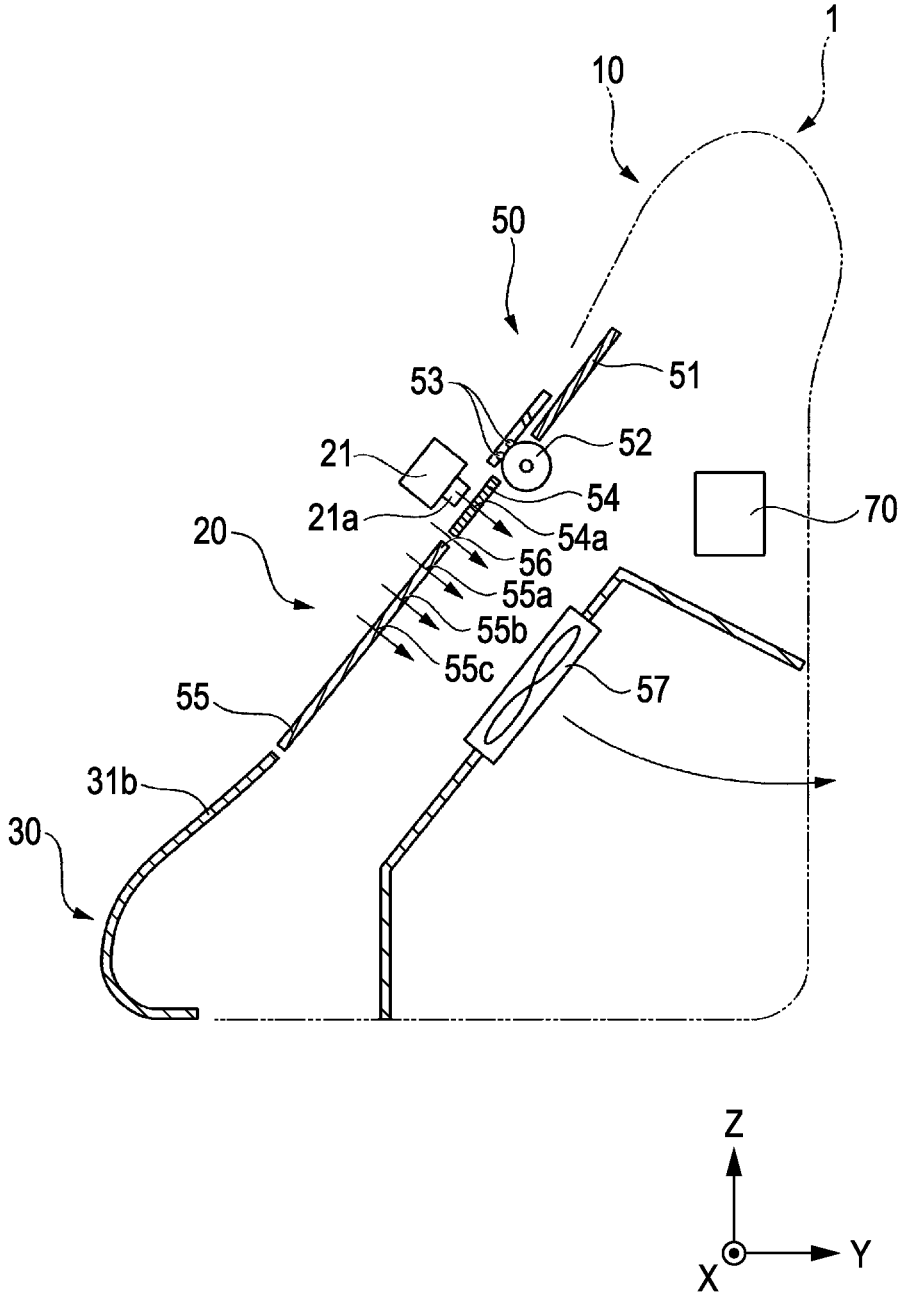
FIG. 3 is a schematic cross-sectional view illustrating an internal configuration of the liquid ejecting system.

FIG. 3 is a schematic cross-sectional view illustrating an internal configuration of the liquid ejecting system 1.

As illustrated in FIG. 3, a paper transportation path 50 from the paper feeding unit 10 toward the paper discharge unit 30 through the recording unit 20 is provided so as to be tilted from an upper rear face side (+YZ direction side) to a lower front face side (−YZ direction side) of the liquid ejecting system 1. The paper transportation path 50 includes a paper feeding guide 51, a paper feeding roller 52, driven rollers 53, a platen 54, a paper suction portion 55, and a paper discharge guide 31*b*. The paper feeding guide 51 is flat and is arranged from the paper feeding unit 10 to the recording unit 20. The paper feeding roller 52 and the driven rollers 53 are arranged so as to be opposed to each other and can be made to be in contact with and to be separated from each other. The platen 54 is a paper transportation guiding portion which is flat and is opposed to the liquid ejecting head 21*a* mounted on the carriage 21. The paper suction portion 55 is flat and is provided between the recording unit 20 and the paper discharge unit 30. The paper discharge guide 31*b* is provided in the paper discharge unit 30.

Each surface of the paper feeding guide 51 and the paper discharge guide 31*b* acts as a paper transportation surface. A surface of the paper suction portion 55 acts as a paper transportation surface and a paper suction surface. The paper suction portion 55 includes suction ports (medium suction portions) 55*a*, 55*b*, 55*c*. The suction ports 55*a*, 55*b*, 55*c* are formed such that a plurality of suction ports are arranged in parallel in the main scanning direction and arranged in three rows in the sub scanning direction. The external air is sucked through each of the suction ports 55*a*, 55*b*, 55*c* by a fan 57 provided in the recording unit 20. Therefore, a roll paper transported on the paper suction portion 55 is attracted.

A surface of the platen 54 acts as a paper transportation guiding surface and as a paper suction surface. The platen 54 includes a plurality of suction ports 54*a* which are alternately arranged in parallel in the main scanning direction. The external air is sucked through each of the suction ports 54*a* by the fan 57 arranged in the recording unit 20. Therefore, a roll paper transported on the platen 54 is attracted. Accordingly, even when a width of a roll paper is large in particular, the roll paper is reliably sucked over the entire width thereof on the platen 54 so as to be made to be in a substantially flat form at the time of recording.

A space 56 is provided between the platen 54 and the suction portion 55. The external air is sucked through the space 56 by the fan 57 so that a roll paper transported on the space 56 is attracted. The platen 54 is divided so as to correspond to the size of a roll paper in the width direction. For example, the platen 54 is divided into seven with a width of 4 inches each. For example, an ink absorbent such as a sponge or a nonwoven fabric is provided on each divided portion.

Figure 4:
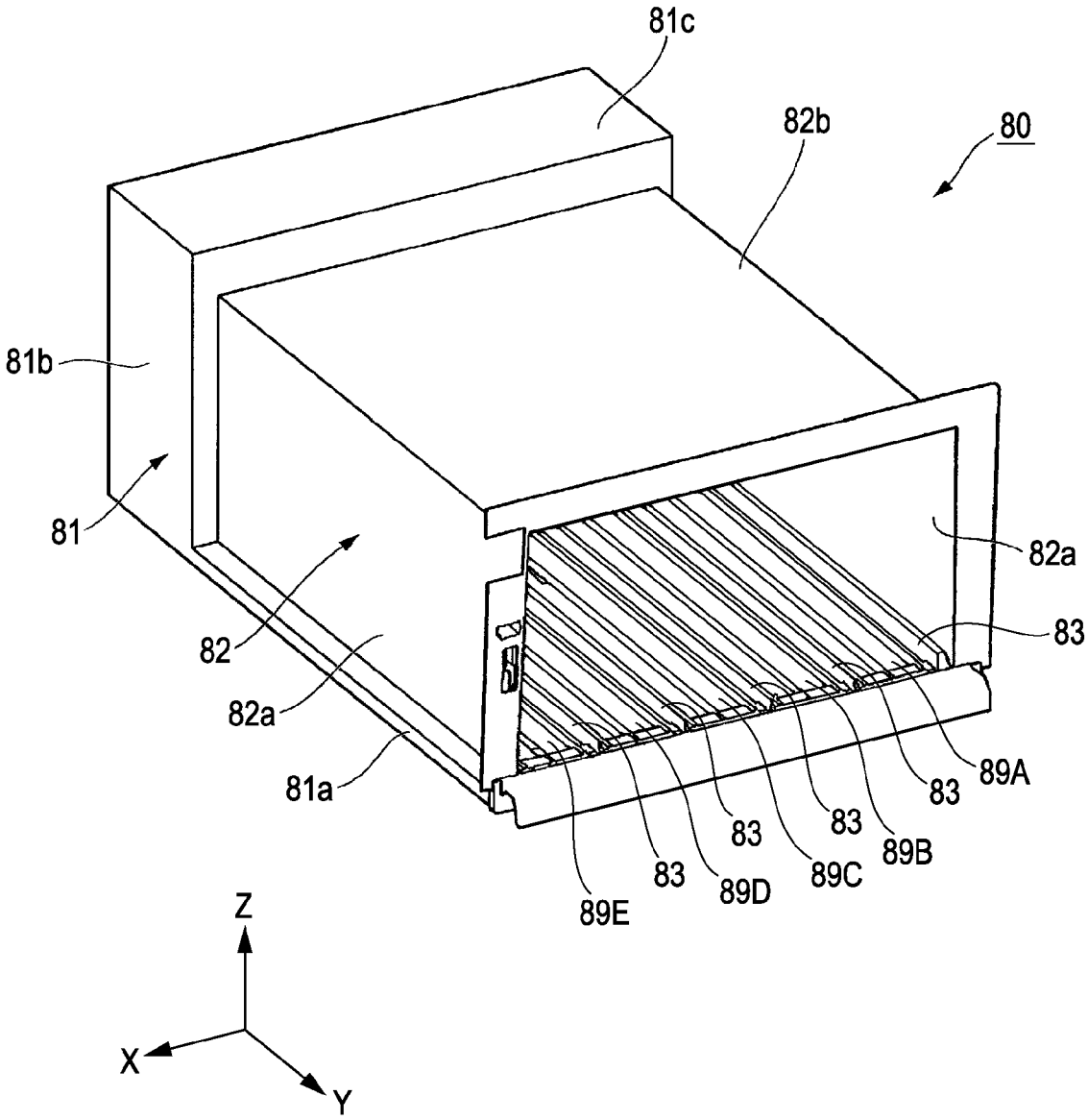
FIG. 4 is a perspective view illustrating a container holder.

FIG. 4 is a perspective view illustrating the cartridge holder 80 to which liquid accommodating containers are attached. FIGS. 5A and 5B are front views illustrating the cartridge holder 80 as illustrated in FIG. 4. FIG. 5A is a front view illustrating the cartridge holder 80. FIG. 5B is an enlarged front view illustrating the movement member 95.

As illustrated in FIG. 4 and FIGS. 5A and 5B, the cartridge holder 80 includes an L-shaped holder main body 81, and a U-shaped frame body 82. The frame body 82 includes a pair of supporting side walls 82*a*, 82*a* and a ceiling wall 82*b* which links upper ends of the supporting side walls 82*a*, 82*a*.

The holder main body 81 includes a substrate 81*a* having a rectangular shape when seen from above and a wall body 81*b* which is attached to an upper surface of the substrate 81*a* at a rear side. The substrate 81*a* is a supporting table on which the ink cartridges 90 are placed in parallel when the ink cartridges 90 are attached to the cartridge holder 80. A plurality of guide rails 83 are extended in row on the substrate 81*a* so as to be in parallel with the Y direction. The guide rails 83 guide the ink cartridges 90 when the ink cartridges 90 are attached/detached to/from the cartridge holder 80. An inner portion of the cartridge holder 80 is partitioned into five cartridge slots 89A, 89B, 89C, 89D, 89E by the guide rails 83. The cartridge slots 89A through 89E function as container attachment portions which accommodate the ink cartridges 90 separately to each color.

The wall body 81*b* is opened to the +Y direction side and a rectangular ceiling plate 81*c* is attached to an upper end of the wall body 81*b*. Slider members 84 are provided on the wall body 81*b*. The slider members 84 are biased to the front side (+Y direction) by biasing units (not shown). That is to say, the slider members 84 are biased in the direction opposite to the attachment direction (−Y direction) of the ink cartridges 90. Inner end surfaces (XZ surfaces) 84*a* of the slider members 84 are surfaces against which ends of the cartridge slots 89A through 89E at the downstream side (−Y direction side) in the attachment direction abut. The slider members 84 are positioned at the front side (+Y direction side) with forces of the biasing units when the ink cartridges 90 are not attached to the cartridge slots 89A through 89E.

If the ink cartridges 90 are inserted into the cartridge slots 89A through 89E, the slider members 84 are moved to the inner side (−Y direction) while being pressed by the front faces of the ink cartridges 90 (faces at the downstream side in the attachment direction). If the ink cartridges 90 are completely attached to the cartridge slots 89A through 89E, the slider members 84 stop at predetermined positions. The slider members 84 apply biasing forces in the direction opposite to the attachment direction to the attached ink cartridges 90 by the biasing units all the time. That is, the slider members 84 apply biasing forces to the attached ink cartridges 90 even when the ink cartridges 90 are attached to the cartridge slots 89A through 89E. The biasing forces act on the ink cartridges 90 so as to press them out to the front side when the ink cartridges 90 are detached from the cartridge slots 89A through 89E.

The movement members 95, position restriction pins 85, air communication ports 86, ink supply pins 87, identification members 88*a* through 88*e* are provided on the wall body 81*b* of the cartridge slots 89A through 89E. The connector terminals 110 are fixed to the wall body 81*b* of the cartridge slots 89A through 89E. The connector terminals 110 are electrically connected to the circuit substrates 100 (see, FIG. 6) which are movably provided in the ink cartridges 90.

The movement members 95 are provided at upper sides of the cartridge slots 89A through 89E and the position restriction pins 85 are provided at lower sides of the cartridge slots 89A through 89E. Each movement member 95 includes a main body 95*a* and a convex portion 95*b*. The convex portion 95*b* makes contact with the circuit substrate 100 when each ink cartridge 90 is attached to the cartridge holder 80. The main body 95*a* has a circular shape and the convex portion 95*b* has a rectangular shape when seen from the front side.

The movement members 95 and the position restriction pins 85 are members for restricting positions of the ink cartridges 90. That is to say, the movement members 95 move the circuit substrates 100 from positions at which the circuit substrates 100 are separated from the connector terminals 110 to positions at which the circuit substrates 100 make contact with the connector terminals 110. At the same time, the movement members 95 function as position restriction pins which restrict positions of the ink cartridges 90.

The air communication ports 86 are provided to be close to the position restriction pins 85 at lower portions in the cartridge slots 89A through 89E. The air communication ports 86 are ports for supplying the air to pairs of the movement members 95 located at an upper position and the position restriction pins 85 located at a lower position, and the ink cartridges 90. The movement members 95 and the position restriction pins 85 are inserted into position restriction holes 98, 99 of the ink cartridges 90, respectively.

The ink supply pins 87 are provided to be close to the movement members 95 at upper sides in the cartridge slots 89A through 89E. The ink supply pins 87 are pins for supplying inks from the ink cartridges 90 to the liquid ejecting head 21*a* (see, FIG. 1) through the ink tubes 25 (see, FIG. 1).

The identification members 88*a* through 88*e* are provided in the cartridge slots 89A through 89E, respectively. The identification members 88*a* through 88*e* are provided at positions between the movement members 95 at the upper sides and the air communication ports 86. The identification members 88*a* through 88*e* are members for preventing the ink cartridges 90 from being mistakenly attached.

Convex-concave fitting portions are formed in front ends of the identification members 88*a* through 88*e*. On the other hand, identification portions 94 (see, FIG. 6) corresponding to shapes of the convex-concave fitting portions in the identification members 88*a* through 88*e* are formed in front end faces in the ink cartridges 90 in the insertion direction. Although the shapes of the identification portions 94 are not illustrated in detail in the drawings, the shapes are different depending on the types of the ink cartridges 90.

That is to say, each convex-concave fitting portion of each of the identification members 88*a* through 88*e* can be fitted into the identification portion 94 of one ink cartridge 90 only and cannot be fitted into the identification portions 94 of other ink cartridges 90. In such a manner, the liquid ejecting system 1 according to the embodiment is configured such that the ink cartridges 90 are not mistakenly attached by combinations of the convex-concave fitting portions of the identification members 88*a* through 88*e* and the identification portions 94 of the ink cartridges 90.

The connector terminals 110 are made to be in contact with the circuit substrates 100 provided on the ink cartridges 90 so as to be electrically connected thereto when the ink cartridges 90 are attached to the cartridge slots 89A through 89E. Details of the circuit substrate 100 and the connector terminal 110 are described later.

Figure 6:
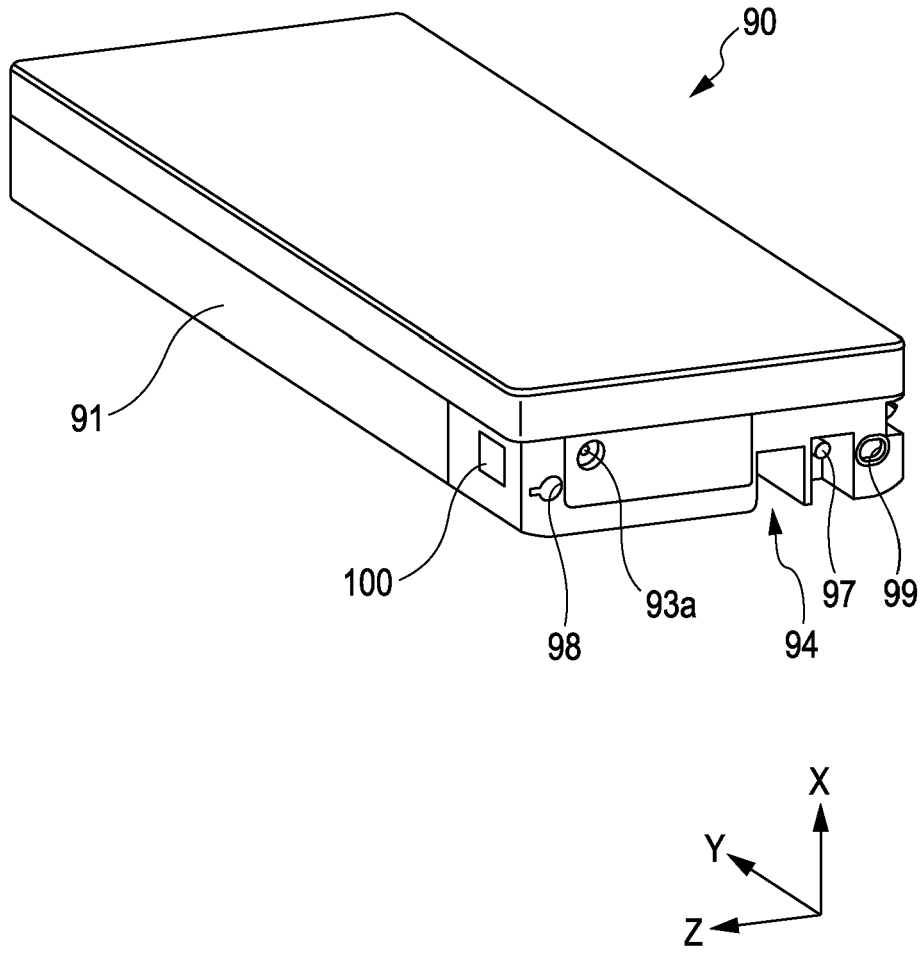
FIG. 6 is a perspective view illustrating a liquid accommodating container.
Figure 7:
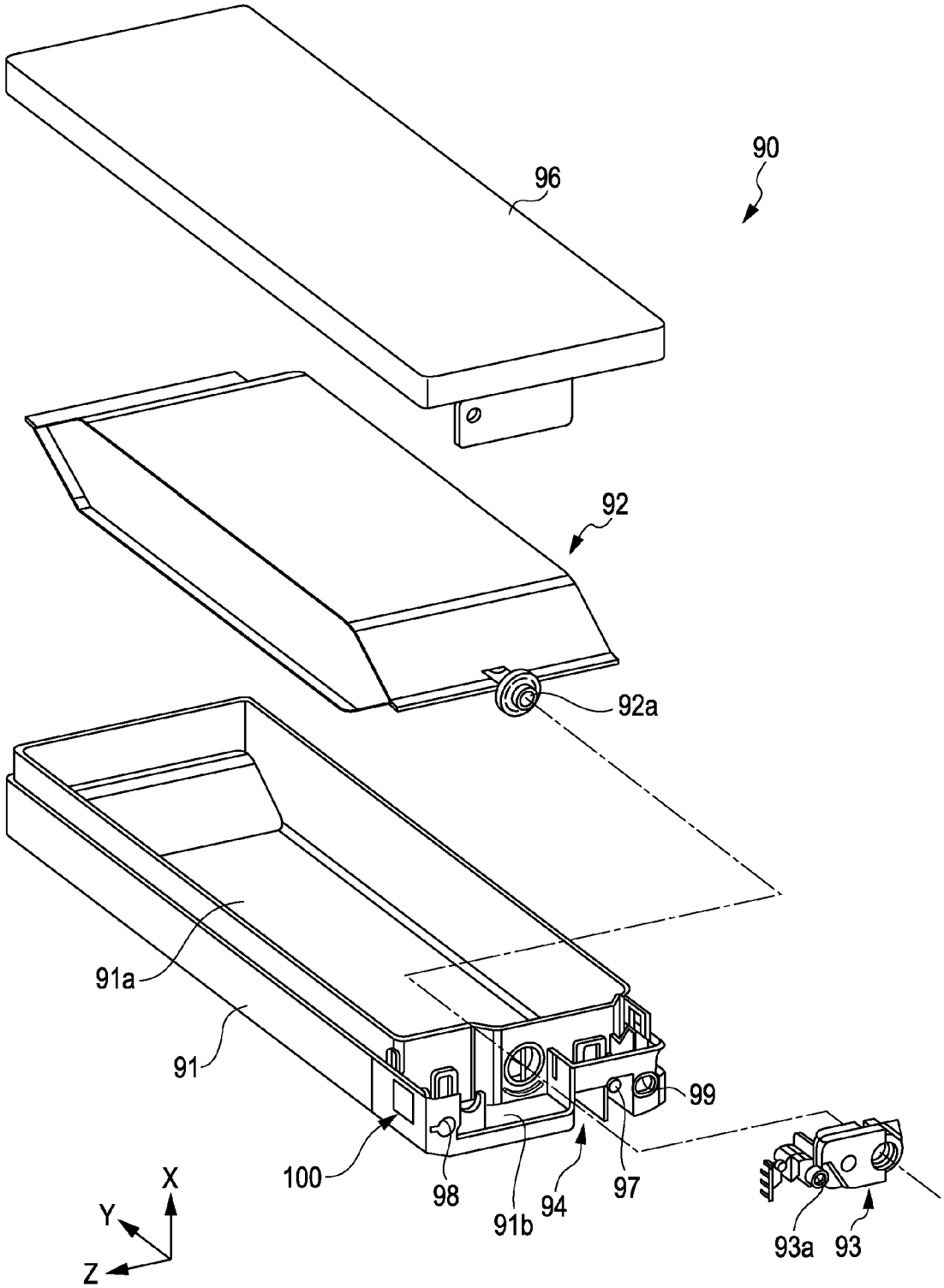
FIG. 7 is an exploded perspective view illustrating the liquid accommodating container.

FIG. 6 is a perspective view illustrating the ink cartridge 90. FIG. 7 is an exploded perspective view of the ink cartridge 90 as illustrated in FIG. 6.

As illustrated in FIG. 6 and FIG. 7, each ink cartridge 90 includes a flattened ink cartridge main body (liquid accommodating container main body) 91 having a substantially rectangular parallelepiped shape and the circuit substrate 100.

A bag accommodating portion 91*a* having a substantial box shape and a detection unit accommodating portion 91*b* are formed in the ink cartridge main body 91. An upper portion of the bag accommodating portion 91*a* is opened. The detection unit accommodating portion 91*b* is positioned at a front face side (−Y direction side) of the bag accommodating portion 91*a*. Further, an ink pack 92 as a liquid accommodating chamber is accommodated in the bag accommodating portion 91*a*. A liquid remaining amount detection unit 93 in which an ink supply port 93*a* (liquid supply port) is provided is accommodated in the detection unit accommodating portion 91*b*.

The liquid remaining amount detection unit 93 is attachable/detachable to/from the ink cartridge main body 91. A remaining amount detection sensor (sensor using a piezoelectric element) (not shown) is provided in the liquid remaining amount detection unit 93. The remaining amount detection sensor is a sensor for detecting a remaining amount of ink in the ink cartridge 90.

A cover 96 covering the bag accommodating portion 91*a* and the detection unit accommodating portion 91*b* is attached to the ink cartridge main body 91. The ink cartridges 90 are attached to the cartridge slots 89A through 89E in an upright manner.

In the embodiment, there are five types of ink cartridges 90. Inks of five colors which are different from each other are stored in the ink packs 92 of the five ink cartridges 90, respectively. Only types of inks stored in the ink packs 92 and shapes of the above identification portions 94 are different from each other and other configurations are the same among these five ink cartridges 90.

The ink supply port 93*a* and an air inflow port 97 are provided in a front end face (face at the −Y direction side) of each ink cartridge 90. The ink supply port 93*a* is connected to an ink discharge port 92*a* of the ink pack 92.

Next, ink supply from the ink packs 92 to the liquid ejecting head 21*a* is described. If the ink cartridges 90 are attached to the cartridge slots 89A through 89E, the above ink supply pins 87 are inserted into the ink supply ports 93*a*. The ink supply pins 87 are connected to the liquid ejecting head 21*a* through the ink tubes 25.

If the ink cartridges 90 are attached to the cartridge slots 89A through 89E, the air inflow ports 97 are inserted into the above air communication ports 86. The air communication ports 86 are connected to pressure pumps through pressurized air supply paths (not shown). The pressure pumps supply pressurized air to the bag accommodating portions 91*a* through the pressurized air supply paths, the air communication ports 86, and the air inflow ports 97 so that the ink packs 92 are pressurized. If the ink packs 92 are pressurized, inks flowing out from the ink discharge ports 92*a* of the ink packs 92 are supplied to the liquid ejecting head 21*a* through the ink supply ports 93*a*.

A pair of position restriction holes 98, 99 are provided in the front end face (face at the −Y direction side) of each ink cartridge 90 so as to be separated from each other.

Next, positional restriction by the position restriction holes 98, 99 and the above pairs of the movement members 95 and the position restriction pins 85 is described. If the ink cartridges 90 are inserted into the cartridge slots 89A through 89E, front ends of the movement members 95 and the position restriction pins 85 are fitted into the position restriction holes 98, 99, respectively. Thereafter, if the ink cartridges 90 are further inserted to inner sides of the cartridge slots 89A through 89E, the ink cartridges 90 are moved based on the movement members 95 and the position restriction pins 85.

If the ink cartridges 90 are completely attached to the cartridge slots 89A through 89E, the position restriction holes 98, 99 and the pairs of the movement members 95 and the position restriction pins 85 are fitted, respectively. Therefore, positions of the ink cartridges 90 in the direction along the front end faces thereof are determined so that the movements of the ink cartridges 90 are restricted.

Each of one position restriction holes 98 is set to be a shape substantially corresponding to a cross-sectional shape perpendicular to an axial direction of the movement member 95 at the upper side. That is, each position restriction hole 98 is set to be a shape including a concave portion corresponding to the convex portion 95*b* of the movement member 95. Each of the other position restriction holes 99 is set to be a shape substantially corresponding to a cross-sectional shape perpendicular to an axial direction of the position restriction pin 85 at the lower side. That is, each position restriction hole 99 is set to be a long elongated hole in the height direction (Z direction) of the ink cartridge main body 91. By setting each of the other position restriction holes 99 to be a long elongated hole in such a manner, a dimensional tolerance or the like can be easily allowed while keeping the positioning accuracy.

Each circuit substrate 100 is provided on a side face (face at the +Z direction side) of each ink cartridge (ink cartridge main body 91) along the attachment direction (−Y direction) in a rotationally movable manner. In other words, each circuit substrate 100 is provided on a side face of the ink cartridge 90, which is in parallel with the attachment direction, in a rotationally movable manner. It is to be noted that being in "parallel" with the attachment direction includes both of a case of being in perfectly parallel with the attachment direction and a case of being in substantially parallel with the attachment direction. A rotational movement mechanism of each circuit substrate 100 is accommodated in the ink cartridge main body 91. The rotational movement mechanism of the circuit substrate 100 is described in detail later.

Figure 8:
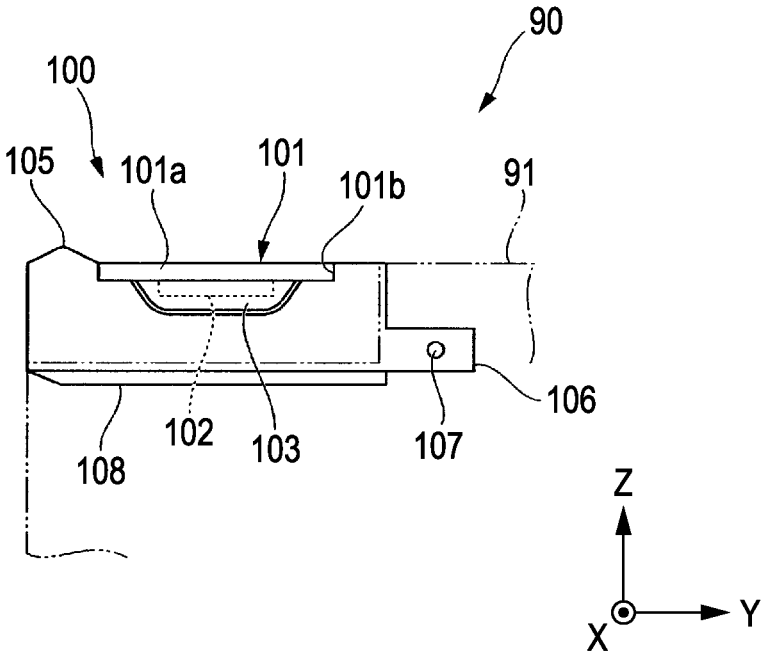
FIG. 8 is a schematic cross-sectional view illustrating a circuit substrate and an attachment portion thereof according to a first embodiment.

FIG. 8 is a schematic cross-sectional view illustrating the circuit substrate 100 and an attachment portion thereof. FIG. 8 illustrates a side end (end at the +Z direction side) of the ink cartridge 90, which is in parallel with the downstream side (−Y direction side) in the attachment direction.

As illustrated in FIG. 8, the circuit substrate 100 includes a circuit element portion 101, a circuit substrate main body 104, a supporting portion 106, a supporting shaft 107, and a guiding portion 108. The circuit element portion 101 is attached in a concave portion 101*b* formed in the circuit substrate main body 104 at a side end (end at the +Z direction side). Thus, a position of the circuit element portion 101 is defined.

An electrode pad 101*a* which is electrically connected to the connector terminal 110 (see, FIG. 9), which will be described later, is formed on a surface (surface at the +Z direction side) of the circuit element portion 101. The electrode pad 101*a* is electrically connected to the above remaining amount detection sensor. A circuit pattern (not shown) is formed and electrically connected with the electrode pad 101*a*. The circuit pattern is covered by a solder resist film (not shown), for example. A memory element 102 such as EEPROM is mounted on a rear face (face at the −Z direction side) of the circuit element portion 101. The memory element 102 is a member for recording pieces of information such as an ink remaining amount and a usage history of the cartridge, for example. The memory element 102 is firmly fixed to the rear face of the circuit element portion 101 with a mold resin 103.

The circuit substrate 100 is movably provided on a side face (face at the +Z direction side) of the ink cartridge 90 (ink cartridge main body 91), which is in parallel with the attachment direction (−Y direction). The circuit substrate 100 rotationally moves about the supporting shaft 107 as a center axis. The supporting shaft 107 supports the supporting portion 106. The supporting shaft 107 is a bar-shaped member extended in the X direction and is positioned at a center portion of the supporting portion 106. Both ends of the supporting shaft 107 are fixed to the ink cartridge main body 91. The circuit substrate 100 rotationally operates from a state where a surface which makes contact with the connector terminal 110 is tilted with respect to the attachment direction (−Y direction) to a state where the surface is in parallel with the attachment direction when the ink cartridge 90 is attached to the cartridge holder 80. In FIG. 8, a state where the circuit substrate 100 is in parallel with the attachment direction is illustrated for convenience.

The guiding portion 108 is provided on a side end (end at the −Z direction side) of the circuit substrate main body 104. An end of the guiding portion 108 at the downstream side in the attachment direction is sloped in a tapered form. The circuit substrate 100 rotationally operates by the movement member 95 which makes contact with the guiding portion 108 and moves when the ink cartridge 90 is attached to the cartridge holder 80.

A projection portion 105 is formed on a side end (end at the +Z direction side) of the circuit substrate main body 104 at the downstream side in the attachment direction so as to be close to the circuit element portion 101. The projection portion 105 is formed so as to project to a surface side (+Z direction side) of the circuit substrate 100. The projection portion 105 functions for preventing the end (end at the −Y direction side) of the circuit element portion 101 from making contact with the connector terminal 110 (see, FIG. 9), which will be described later. To be more specific, when the circuit substrate main body 104 is formed with a glass epoxy material, if the connector terminal 110 makes direct contact with the circuit substrate main body 104, the following problem arises. That is, a problem that the end of the circuit element portion 101 is chipped off or being the like and damaged arises. Therefore, it is so configured that the end of the circuit element portion 101 does not make contact with the connector terminal 110.

When the circuit substrate and the connector terminal are connected to each other in a slide contact manner, if there are dusts on a slide contact path, there is a risk that the dusts adhere to the connector terminal and get into between the circuit substrate and the connector terminal. This causes insufficient contact between the circuit substrate and the connector terminal. Therefore, data cannot be transmitted and received to and from a memory element (semiconductor storage unit) mounted on the circuit substrate. Accordingly, there arises a problem that a printer cannot be normally operated or being the like. When a projection portion is formed on an attachment portion of the circuit substrate, if the circuit substrate is connected to the connector terminal in a slide contact manner, a surface of the projection portion is rubbed with the connector terminal. Therefore, when the projection portion is formed with a resin material, for example, the material of the projection portion is scratched off. Then, the resin material becomes dusts in a powder form and adheres to the connector terminal. Therefore, there is a risk that the above problem does occur.

Then, the liquid ejecting system 1 according to the invention includes the circuit substrates 100, the connector terminals 110, and the movement members 95. The circuit substrates 100 are movably provided on side faces of the ink cartridge main bodies 91, which are in parallel with the attachment direction. The connector terminals 110 are attached to the cartridge holder 80 which is in parallel with the attachment direction. The movement members 95 are provided on the cartridge holder 80 and move the circuit substrates 100 from positions at which the circuit substrates 100 are separated from the connector terminals 110 to positions at which the circuit substrates 100 make contact with the connector terminals 110 when the ink cartridge main bodies 91 are attached to the cartridge holder 80. With this, an electrical conduction failure between the circuit substrates 100 and the connector terminals 110 is eliminated and a normal printing operation can be ensured in the liquid ejecting system 1. Hereinafter, the connector terminals 110 and the movement members 95 are described in detail with reference to FIG. 9.

Figure 9:
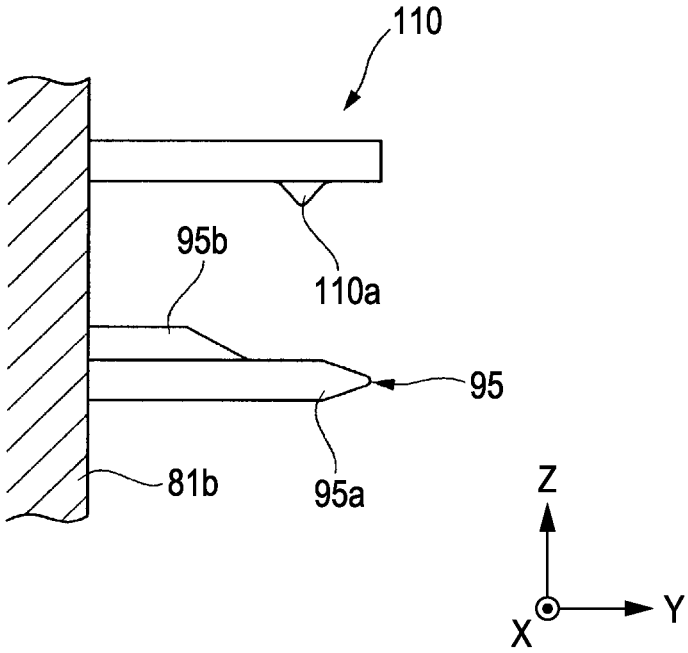
FIG. 9 is a schematic cross-sectional view illustrating a connector terminal and a movement member according to the first embodiment.

FIG. 9 is a schematic cross-sectional view illustrating the connector terminal 110 and the movement member 95. FIG. 9 illustrates a side end (end at the −Z direction side) of the cartridge holder 80, which is in parallel with the downstream side (−Y direction side) in the attachment direction.

As illustrated in FIG. 9, the connector terminal 110 is attached to a side face of the cartridge holder 80, which is in parallel with the attachment direction. To be more specific, a base end of the connector terminal 110 is supported by a surface of a wall body 81*b* on the +Y direction side and is attached thereto so as to be elastically swingable. The connector terminal 110 is formed with an elastic metal material such as copper.

A contact portion 110*a* which is electrically connected to the electrode pad 101*a* of the circuit substrate 100 is formed on a surface (surface at the −Z direction side) of the connector terminal 110. The contact portion 110*a* is provided at a position corresponding to the electrode pad 101*a*. The connector terminal 110 is electrically connected to a control circuit in the printer main body 2 through a wiring (not shown).

A base end of the movement member 95 is supported by a surface of the wall body 81*b* on the +Y direction side. The movement member 95 is arranged at a position opposed to the connector terminal 110 so as to be separated therefrom by a predetermined distance. An end of the convex portion 95*b* of the movement member 95 at the upstream side in the attachment direction is sloped in a tapered form. The movement member 95 moves the circuit substrate 100 from a position at which the circuit substrate 100 is separated from the connector terminal 110 to a position at which the circuit substrate 100 makes contact with the connector terminal 110 when the ink cartridge 90 is attached to the cartridge holder 80.

With such configuration, when the ink cartridge 90 is attached to the cartridge holder 80, the electrode pad 101*a* of the circuit substrate 100 makes contact with the contact portion 110*a* of the connector terminal 110. Therefore, the memory element 102 and the remaining amount detection sensor are electrically connected to a control circuit in the printer main body 2 through the circuit substrate 100. This makes it possible to control operations of the memory element 102 and the remaining amount detection sensor from the side of the printer main body 2.

Figure 10A:
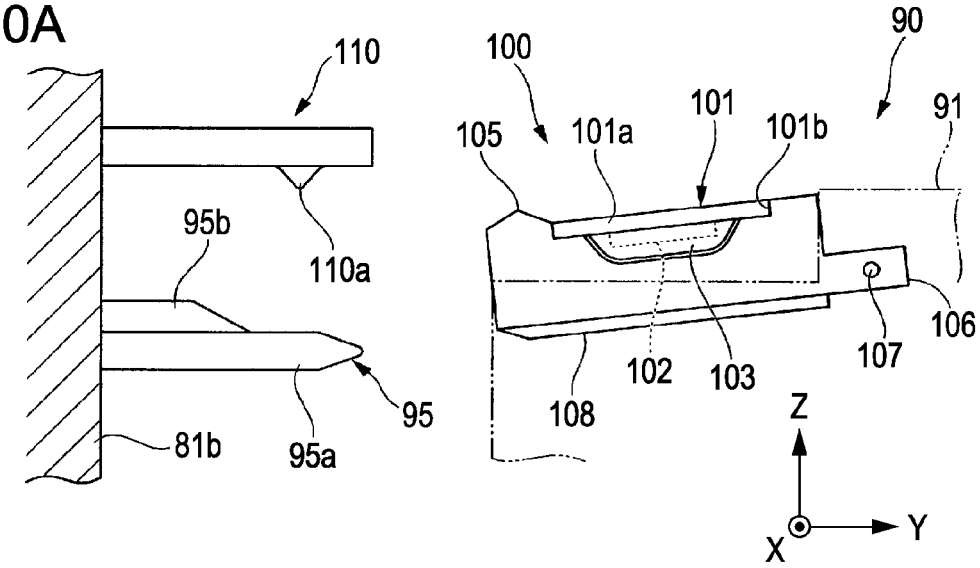
FIGS. 10A through 10C are schematic cross-sectional views illustrating a moving state of the circuit substrate according to the first embodiment.
Figure 10B:
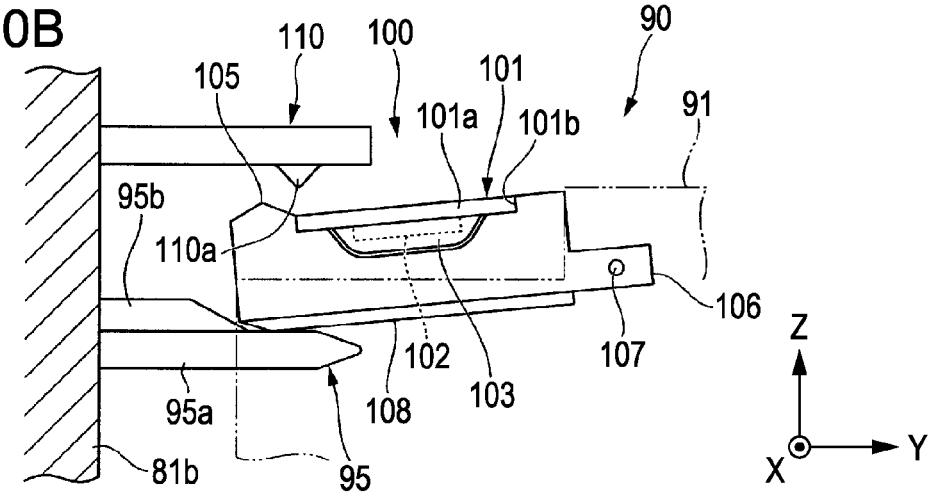
Figure 10C:
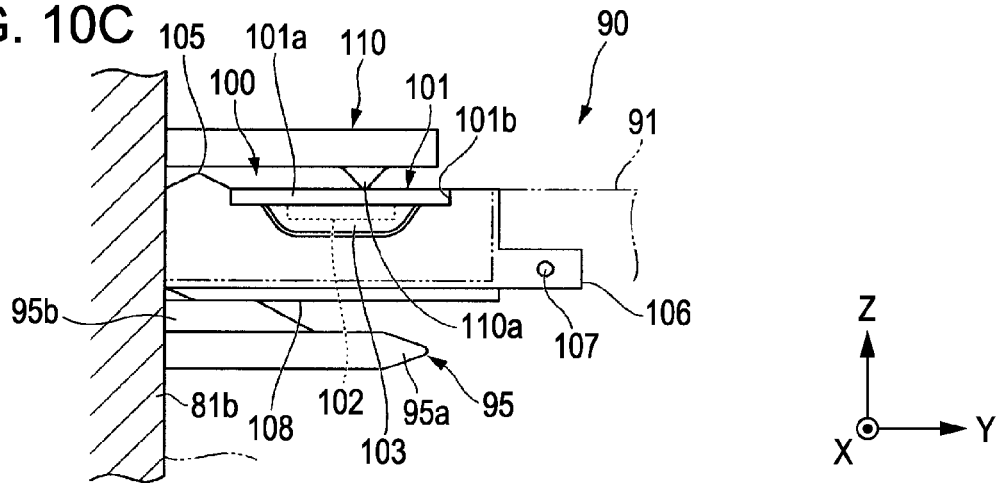

FIGS. 10A through 10C are schematic cross-sectional views illustrating a moving state of the circuit substrate 100 in the first embodiment. FIG. 10A is a view illustrating a state before the ink cartridge 90 is attached to the cartridge holder 80. FIG. 10B is a view illustrating a state when the ink cartridge 90 is being attached to the cartridge holder 80. FIG. 10C is a view illustrating a state after the ink cartridge 90 is completely attached to the cartridge holder 80. In FIGS. 10A through 10C, the position restriction hole 98 into which the movement member 95 is inserted is not illustrated for sake of convenience.

Then, a moving state of the circuit substrate 100 is described in which the circuit substrate 100 is moved from the position at which the circuit substrate 100 is separated from the connector terminal 110 to the position at which the circuit substrate 100 makes contact with the connector terminal 110 when the ink cartridge 90 is attached to the cartridge holder 80.

At first, as illustrated in FIG. 10A, a state before the ink cartridge 90 is attached to the cartridge holder 80, that is, a state before the movement member 95 makes contact with the circuit substrate 100 is considered. In this case, the circuit substrate 100 is tilted with respect to the attachment direction at a predetermined angle. To be more specific, a posture of the circuit substrate 100 is held by a holding member (not shown) such as a stopper in a state where an end thereof (end at the −YZ direction side) gets into the ink cartridge main body 91. The movement member 95 is positioned at a lower side (−Z direction side) with respect to the supporting shaft 107 of the circuit substrate 100. The projection portion 105 is separated from the contact portion 110*a* of the connector terminal 110 by a predetermined distance.

Next, as illustrated in FIG. 10B, a state when the ink cartridge 90 is being attached to the cartridge holder 80, that is, a state when the movement member 95 makes contact with the circuit substrate 100 to move the circuit substrate 100 is considered. The movement member 95 is positioned at a lower side (−Z direction side) with respect to the supporting shaft 107 of the circuit substrate 100 in a state before the ink cartridge 90 is attached to the cartridge holder 80. Therefore, the movement member 95 is inserted into the position restriction hole 98 (see, FIG. 7). Thereafter, if the movement member 95 makes contact with the guiding portion 108 at the lower side of the circuit substrate 100 and moves in the attachment direction, the circuit substrate 100 rotationally moves about the supporting shaft 107 in the clockwise direction. That is to say, the circuit substrate 100 rotationally moves from a state where the circuit substrate 100 is tilted with respect to the attachment direction at a predetermined angle such that an angle gradient thereof becomes smaller.

The position restriction hole 98 has a concave portion corresponding to the convex portion 95*b* of the movement member 95. Therefore, the movement member 95 can move along the concave portion. Both of an end of the guiding portion 108 at the downstream side in the attachment direction and an end of the convex portion 95*b* of the movement member 95 at the upstream side in the attachment direction are sloped in a tapered form. Therefore, the circuit substrate 100 rotationally moves smoothly.

The projection portion 105 is separated from the contact portion 110*a* by a predetermined distance in a state before the ink cartridge 90 is attached to the cartridge holder 80. Therefore, the projection portion 105 does not make contact with any portions in a moving process of the movement member 95. Further, the contact portion 110*a* does not make contact with any portions until the contact portion 110*a* makes contact with the electrode pad 101*a*.

Therefore, even when there are dusts on a slide contact path as in the existing technique, a problem that the dusts adhere to the connector terminal and get into between the circuit substrate and the connector terminal does not occur. Further, even when a projection portion is formed on an attachment portion of the circuit substrate, a problem that a surface of the projection portion is rubbed with the connector terminal and the material of the projection portion is scratched off does not occur.

As illustrated in FIG. 10C, a state after the ink cartridge 90 is completely attached to the cartridge holder 80 will be considered. In this case, the circuit substrate 100 is in parallel with the attachment direction. That is, the electrode pad 101*a* of the circuit substrate 100 makes contact with the contact portion 110*a* of the connector terminal 110. Therefore, the memory element 102 and the remaining amount detection sensor are electrically connected to the control circuit in the printer main body 2 through the circuit substrate 100. This makes it possible to control operations of the memory element 102 and the remaining amount detection sensor from the side of the printer main body 2.

With the liquid ejecting system 1 according to the embodiment, when the ink cartridge 90 is attached to the cartridge holder 80, the movement of the movement member 95 in the attachment direction makes the circuit substrate 100 move from a position at which the circuit substrate 100 is separated from the connector terminal 110 to a position at which the circuit substrate 100 makes contact with the connector terminal 110. Therefore, the circuit substrate 100 can be made not to be in contact with any portions until the circuit substrate 100 makes contact with the connector terminal 110. Therefore, even when there are dusts on a slide contact path as in the existing technique, a problem that the dusts adhere to the connector terminal and get into between the circuit substrate and the connector terminal does not occur. Further, even when a projection portion is formed on an attachment portion of the circuit substrate, a problem that a surface of the projection portion is rubbed with the connector terminal and the material of the projection portion is scratched off does not occur. Accordingly, the liquid ejecting system 1 which eliminates an electrical conduction failure between the circuit substrate 100 and the connector terminal 110 and can ensure a normal printing operation can be provided.

With this configuration, the movement member 95 moves the circuit substrate 100 from the position at which the circuit substrate 100 is separated from the connector terminal 110 to the position at which the circuit substrate 100 makes contact with the connector terminal 110 while functioning as a position restriction pin which restricts a position of the ink cartridge 90. That is to say, since the movement member 95 is a position restriction pin, by adding a function as a movement member to the position restriction pin, the circuit substrate 100 can be moved from the position at which the circuit substrate 100 is separated from the connector terminal 110 to the position at which the circuit substrate 100 makes contact with the connector terminal 110 when the ink cartridge 90 is attached to the cartridge holder 80. Accordingly, the movement member 95 is not required to be separately provided in addition to the position restriction pin. This makes it possible to suppress an apparatus from being increased in size.

With this configuration, by providing the convex portion 95*b* to the position restriction pin as the movement member 95, the circuit substrate 100 can be moved from the position at which the circuit substrate 100 is separated from the connector terminal 110 to the position at which the circuit substrate 100 makes contact with the connector terminal 110 when the ink cartridge 90 is attached to the cartridge holder 80. Further, the position restriction hole 98 of the ink cartridge 90 includes a concave portion corresponding to the convex portion 95*b*. Therefore, the movement member 95 can be moved along the concave portion. Accordingly, the position restriction pin can be operated as the movement member 95 with a simple configuration.

With this configuration, when the ink cartridge 90 is attached to the cartridge holder 80, the circuit substrate 100 rotationally operates from a state where the circuit substrate 100 is tilted with respect to the attachment direction at a predetermined angle to a state where the circuit substrate 100 is in parallel with the attachment direction. Therefore, a rotational movement mechanism of the circuit substrate 100 is easily accommodated in the ink cartridge main body 91. To be more specific, a moving space of the circuit substrate 100 can be made smaller in comparison with a case where the circuit substrate 100 is not rotationally operated (for example, a configuration in which the circuit substrate 100 is moved in a slide manner). Therefore, a space for providing a slide mechanism is not required. This makes it possible to suppress an apparatus from being increased in size.

With the ink cartridge 90 according to the embodiment, the circuit substrate 100 can be made not to be in contact with any portions until the circuit substrate 100 makes contact with the connector terminal 110 since the ink cartridge 90 is used in the above liquid ejecting system 1. Accordingly, the ink cartridge 90 which eliminates an electrical conduction failure between the circuit substrate 100 and the connector terminal 110 and can ensure a normal printing operation can be provided.

With the printer main body 2 according to the embodiment, the connector terminals 110 can be made not to be in contact with any portions until the circuit substrate 100 makes contact with the connector terminal 110 since the printer main body 2 is used in the above liquid ejecting system 1. Accordingly, the printer main body 2 which eliminates an electrical conduction failure between the circuit substrate 100 and the connector terminal 110 and can ensure a normal printing operation can be provided.

In the embodiment, the movement member 95 makes contact with the guiding portion 108 of the circuit substrate 100 so as to move the circuit substrate 100. However, the configuration is not limited thereto. For example, the movement member 95 may move the circuit substrate 100 without making contact with the guiding portion 108. To be more specific, magnetic members such as magnets are used for the movement member 95 and the guiding portion 108 and the circuit substrate 100 can be moved with a magnetic force generated between the movement member 95 and the guiding portion 108 even in a case where the movement member 95 and the circuit substrate 100 are separated from each other.

At this time, a force attracting each other may act between the movement member 95 and the guiding portion 108 (for example, magnets having polarities opposite to each other may be used). Alternatively, a force repelling each other may act between the movement member 95 and the guiding portion 108 (for example, magnets having the same polarity may be used). When the force attracting each other acts between the movement member 95 and the guiding portion 108, a magnetic member is arranged at the side at which the connector terminal 110 is arranged (upper side (+Z direction side) with respect to the supporting shaft 107 of the circuit substrate 100). When the force repelling each other acts between the movement member 95 and the guiding portion 108, a magnetic member is arranged at a side opposite to the side at which the connector terminal 110 is arranged (lower side (−Z direction side) with respect to the supporting shaft 107 of the circuit substrate 100). Thus, a magnetic force is required to act therebetween such that the circuit substrate 100 is made closer to the connector terminal 110.

In the embodiment, the circuit substrate 100 is attached to an end of the ink cartridge main body 91 at the +Z direction side. However, the configuration is not limited thereto. For example, the circuit substrate 100 may be attached to an end of the ink cartridge main body 91 at the −Z direction side or attached to an end of the ink cartridge main body 91 at the +X direction side or an end thereof at the −X direction side. That is to say, it is sufficient that the circuit substrate 100 is movably provided on a side face of the ink cartridge main body 91, which is in parallel with the attachment direction.

In the embodiment, a base end of the connector terminal 110 is supported by a face of the wall body 81*b* on the +Y direction side. However, the configuration is not limited thereto. For example, a rear face of the connector terminal 110 (face opposite to the side at which the contact portion 110*a* is formed) may be supported by a face of the ceiling plate 81*c* at the −Z direction side. That is to say, it is sufficient that the connector terminal 110 is arranged at a position corresponding to a position at which the circuit substrate 100 is arranged and fixed to a side face of the cartridge holder 80, which is in parallel with the attachment direction.

In the embodiment, the movement member 95 is formed such that the main body 95*a* is circular and the convex portion 95*b* is rectangular when seen from the front side. However, the shape of the movement member 95 is not limited thereto. For example, the shape of the movement member 95 (main body 95*a*, convex portion 95*b*) may be various shapes such as a circular shape, an elliptical shape, a rectangular shape, a star shape or a shape obtained by combining these shapes.

In the embodiment, a case where the circuit substrate 100 rotationally moves about the supporting shaft 107 has been described as an example. However, the configuration is not limited to the case. Hereinafter, a movement mechanism of the circuit substrate, which is different from that in the embodiment, is described with reference to FIG. 11 and FIG. 12.

Second Embodiment

Figure 11:
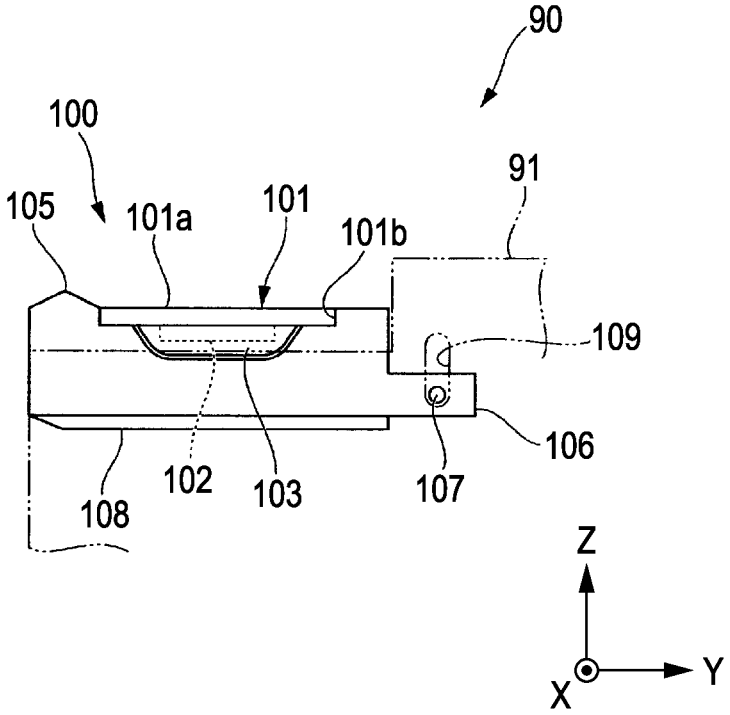
FIG. 11 is a schematic view illustrating a circuit substrate and an attachment portion according to a second embodiment.
Figure 12:
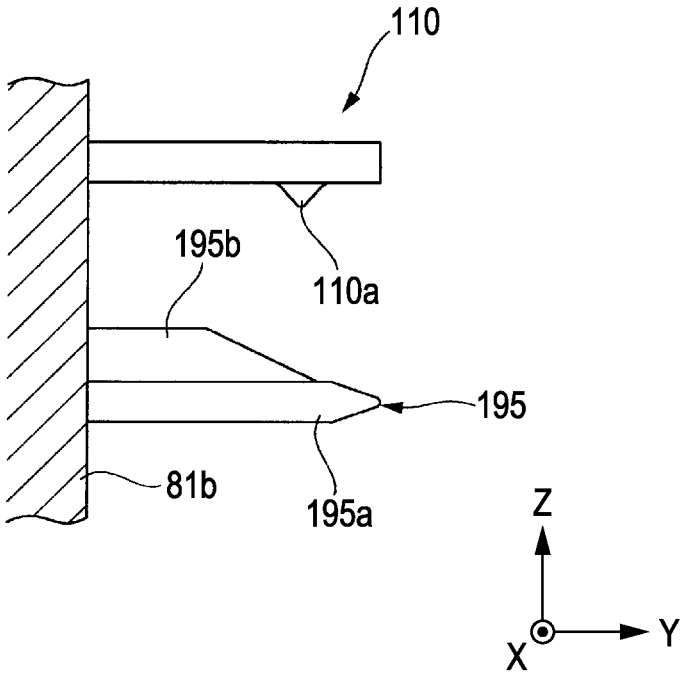
FIG. 12 is a schematic plan view illustrating a connector terminal and a movement member according to the second embodiment.

FIG. 11 is a schematic view illustrating a circuit substrate and an attachment portion thereof according to the second embodiment. FIG. 12 is a schematic plan view illustrating a connector terminal and a movement member according to the second embodiment. FIG. 11 corresponds to FIG. 8 and illustrates a side end (end at the +Z direction side) of the ink cartridge 90, which is in parallel with the downstream side (−Y direction side) in the attachment direction.

FIG. 12 corresponds to FIG. 9 and illustrates a side end (end at the −Z direction side) of the cartridge holder 80, which is in parallel with the downstream side (−Y direction side) in the attachment direction. A rotational movement configuration in the embodiment is different from that in the first embodiment in a point that the circuit substrate 100 slides based on the supporting shaft 107 as a base axis. In FIG. 11 and FIG. 12, the same reference numerals denote the same components as those in FIG. 8 and FIG. 9 and detailed description thereof is not repeated.

As illustrated in FIG. 11, the circuit substrate 100 is movably provided on a side face (face at the +Z direction side) of the ink cartridge 90 (ink cartridge main body 91), which is in parallel with the attachment direction (−Y direction). Guide holes 109 which hold the supporting shaft 107 in a slidable manner are formed in the ink cartridge main body 91. The guide holes 109 are elongated holes extended in the Z direction. The circuit substrate 100 slides along the guide holes 109 based on the supporting shaft 107 which supports the supporting portion 106 as a base axis. Both ends of the supporting shaft 107 are held by the guide holes 109 of the ink cartridge main body 91. The circuit substrate 100 slides from a state where a surface which makes contact with the connector terminal 110 is located at a position in the −Z direction to a state where the surface is located at a position in the +Z direction when the ink cartridge 90 is attached to the cartridge holder 80. In FIG. 11, the state in which the circuit substrate 100 is located at a position in the −Z direction is illustrated for convenience.

As illustrated in FIG. 12, a base end of a movement member 195 is supported by a surface of the wall body 81*b* on the +Y direction side. The movement member 195 is arranged at a position facing the connector terminal 110 so as to be separated therefrom by a predetermined distance. The movement member 195 includes a main body 195*a* and a convex portion 195*b*. The convex portion 195*b* makes contact with the circuit substrate 100 when the ink cartridge 90 is attached to the cartridge holder 80. An end of the convex portion 195*b* of the movement member 195 at the upstream side in the attachment direction is sloped in a tapered form. The height of the convex portion 195*b* (a distance from an upper surface of the main body 195*a* to a top of the convex portion 195*b*) is substantially the same as the length of the guide holes 109 of the ink cartridge main body 91. The movement member 195 moves the circuit substrate 100 from a position at which the circuit substrate 100 is separated from the connector terminal 110 to a position at which the circuit substrate 100 makes contact with the connector terminal 110 when the ink cartridge 90 is attached to the cartridge holder 80.

Figure 13A:
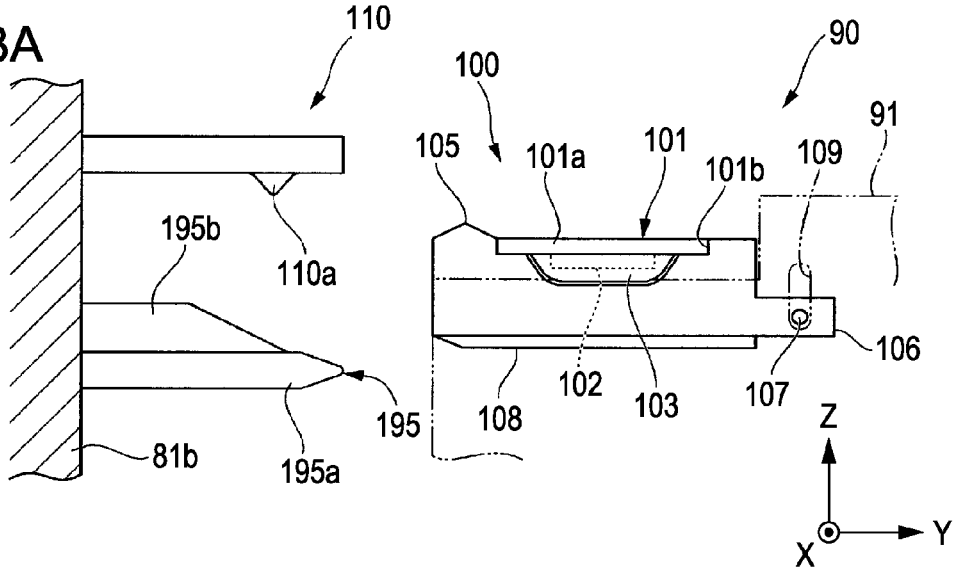
FIGS. 13A through 13C are schematic cross-sectional views illustrating a moving state of the circuit substrate according to the second embodiment.
Figure 13B:
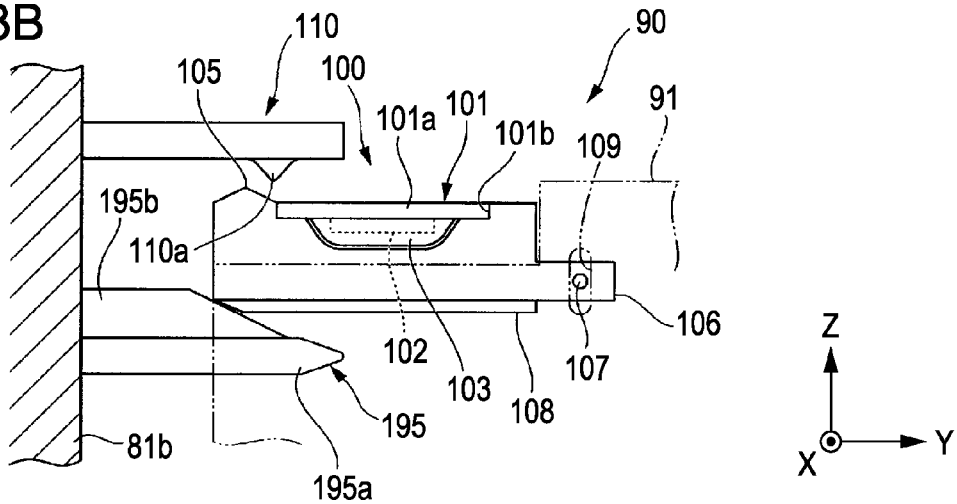
Figure 13C:
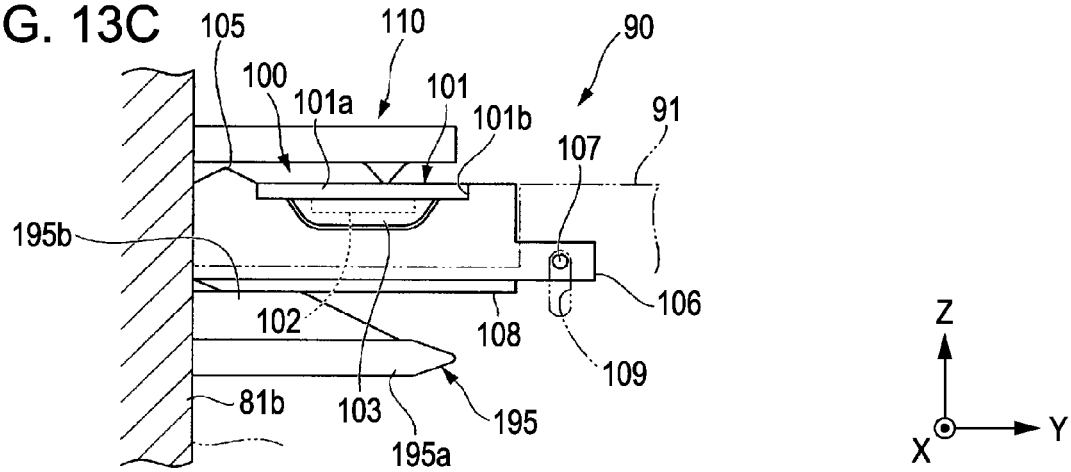

FIGS. 13A through 13C are schematic cross-sectional views illustrating a moving state of the circuit substrate 100 in the second embodiment. FIG. 13A is a view illustrating a state before the ink cartridge 90 is attached to the cartridge holder 80 and corresponds to FIG. 10A. FIG. 13B is a view illustrating a state when the ink cartridge 90 is being attached to the cartridge holder 80 and corresponds to FIG. 10B. FIG. 13C is a view illustrating a state after the ink cartridge 90 is completely attached to the cartridge holder 80 and corresponds to FIG. 10C. In FIGS. 13A through 13C, a position restriction hole into which the movement member 195 is inserted is not illustrated for sake of convenience.

Then, a moving state of the circuit substrate 100 is describe in which the circuit substrate 100 is moved from the position at which the circuit substrate 100 is separated from the connector terminal 110 to the position at which the circuit substrate 100 makes contact with the connector terminal 110 when the ink cartridge 90 is attached to the cartridge holder 80.

At first, as illustrated in FIG. 13A, a state before the ink cartridge 90 is attached to the cartridge holder 80, that is, a state before the movement member 195 makes contact with the circuit substrate 100 is considered. In this case, the circuit substrate 100 is lowered in the −Z direction by a predetermined distance. To be more specific, a posture of the circuit substrate 100 is held by a holding member (not shown) such as a stopper in a state where an end thereof (end at the −Z direction side) gets into the ink cartridge main body 91. A tapered portion of the convex portion 195*b* of the movement member 195 is located at a position facing a tapered portion of the guiding portion 108 of the circuit substrate 100. The projection portion 105 is separated from the contact portion 110*a* of the connector terminal 110 by a predetermined distance.

Next, as illustrated in FIG. 13B, a state when the ink cartridge 90 is being attached to the cartridge holder 80, that is, a state when the movement member 195 makes contact with the circuit substrate 100 to move the circuit substrate 100 is considered. The tapered portion of the convex portion 195*b* of the movement member 195 is located at a position facing the tapered portion of the guiding portion 108 of the circuit substrate 100 in a state before the ink cartridge 90 is attached to the cartridge holder 80. Therefore, the movement member 195 is inserted into the position restriction hole (not shown), and thereafter, if the movement member 195 makes contact with the guiding portion 108 at the lower side of the circuit substrate 100 and moves in the attachment direction, the circuit substrate 100 slides in the +Z direction based on the supporting shaft 107 as a base axis. That is to say, the circuit substrate 100 slides from a state where the circuit substrate 100 is separated with respect to the attachment direction by a predetermined distance to a state such that the distance becomes smaller.

Both of an end of the guiding portion 108 at the downstream side in the attachment direction and an end of the convex portion 195*b* of the movement member 195 at the upstream side in the attachment direction are sloped in a tapered form. Therefore, the circuit substrate 100 slides smoothly.

The projection portion 105 is separated from the contact portion 110*a* by a predetermined distance in a state before the ink cartridge 90 is attached to the cartridge holder 80. Therefore, the projection portion 105 does not make contact with any portions during the movement of the movement member 195. Further, the contact portion 110*a* does not make contact with any portions until the contact portion 110*a* makes contact with the electrode pad 101*a*.

As illustrated in FIG. 10C, a state after the ink cartridge 90 is completely attached to the cartridge holder 80 is considered. In this case, the circuit substrate 100 is in a state where the circuit substrate 100 has moved up in the +Z direction. That is, the electrode pad 101*a* of the circuit substrate 100 makes contact with the contact portion 110*a* of the connector terminal 110. Therefore, the memory element 102 and the remaining amount detection sensor are electrically connected to the control circuit in the printer main body 2 through the circuit substrate 100. This makes it possible to control operations of the memory element 102 and the remaining amount detection sensor from the side of the printer main body 2.

Third Embodiment

A liquid ejecting system 1 according to the embodiment includes a liquid ejecting head 21*a*, ink cartridges 90 (ink cartridge main bodies 91) (see, FIG. 16), a cartridge holder 80, first circuit substrates 300 (see, FIG. 16), first connector terminals 121, and movement members 295. The liquid ejecting head 21*a* ejects ink (liquid). The ink cartridges 90 (ink cartridge main bodies 91) accommodate the ink. The ink cartridges 90 are detachably attached to the cartridge holder 80. The first circuit substrates 300 are fixed to side faces of the ink cartridges 90, which are along an attachment direction in which the ink cartridges 90 are attached to the cartridge holder 80 (hereinafter, referred to as attachment direction). The first connector terminals 121 are movably provided on a side face of the cartridge holder 80, which is in parallel with the attachment direction. The movement members 295 are provided on the ink cartridges 90 at the downstream side in the attachment direction. Further, the movement members 295 move the first connector terminals 121 from positions at which the first connector terminals 121 are separated from the first circuit substrates 300 to positions at which the first connector terminals 121 make contact with the first circuit substrates 300 when the ink cartridges 90 are attached to the cartridge holder 80.

The printer main body 2 includes the liquid ejecting head 21*a*, the cartridge holder 80 and the first connector terminals 121 and is used in the liquid ejecting system 1. That is to say, the printer main body 2 is an apparatus obtained by removing the ink cartridges 90 from the liquid ejecting system 1. Each ink cartridge 90 includes the ink cartridge main body 91, the first circuit substrate 300, and the movement member 295, and is used in the liquid ejecting system 1.

Figure 14:
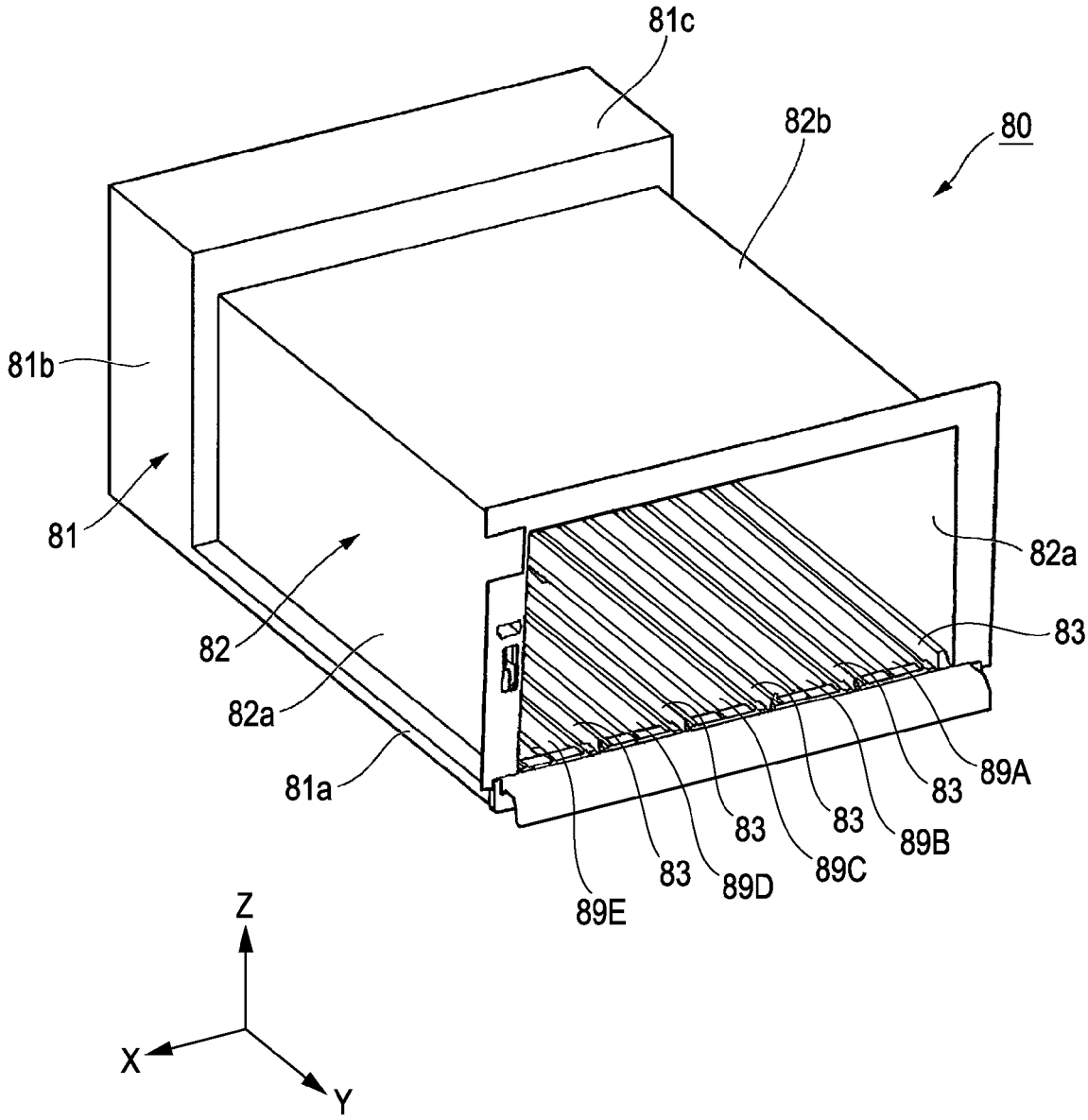
FIG. 14 is a perspective view illustrating a container holder according to a third embodiment.
Figure 15:
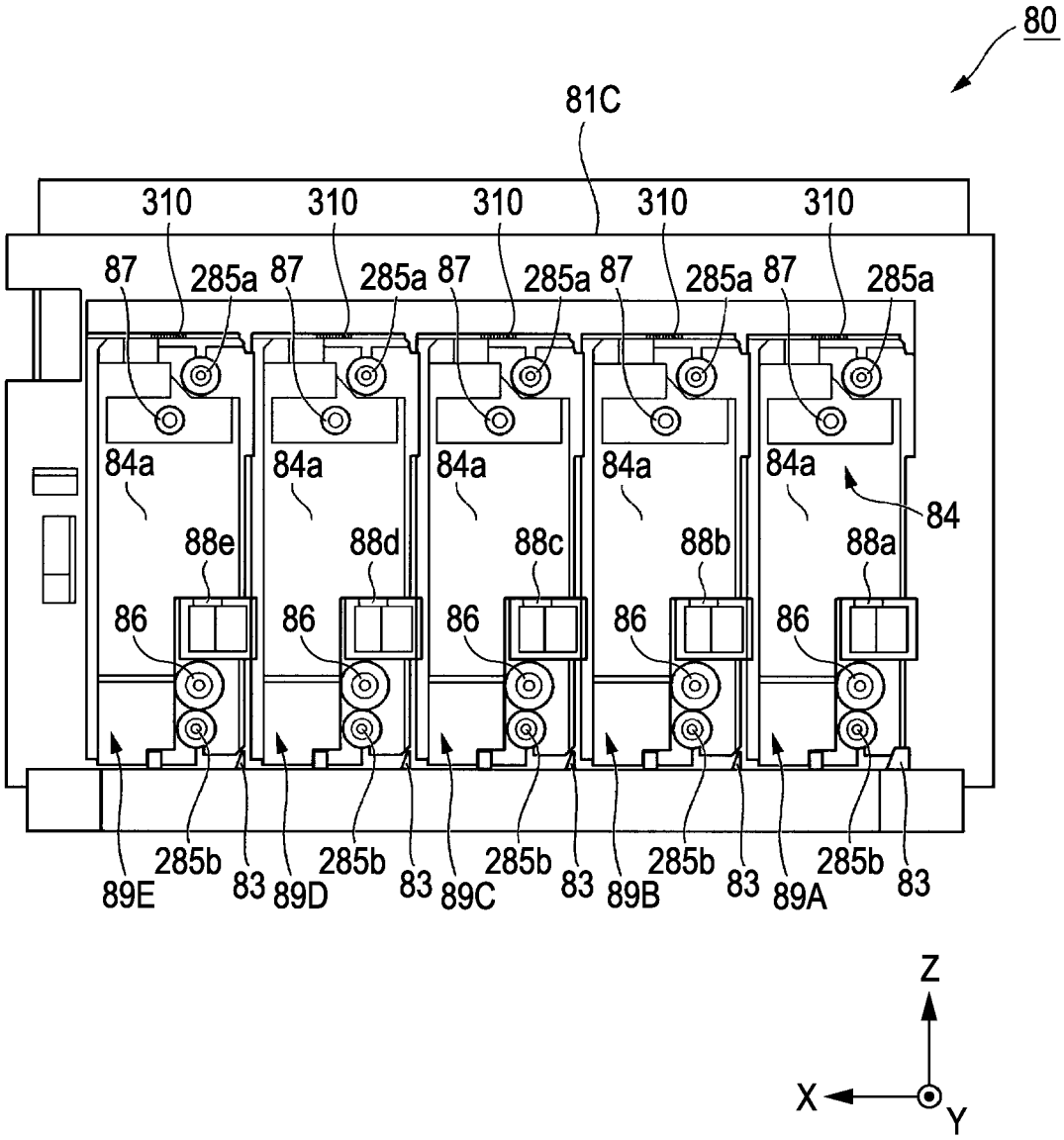
FIG. 15 is a front view illustrating the container holder according to the third embodiment.

FIG. 14 is a perspective view illustrating the cartridge holder 80 to which a liquid accommodating container is attached. FIG. 15 is a front view illustrating the cartridge holder 80 as illustrated in FIG. 14.

Pairs of positioning pins 285*a*, 285*b*, air communication ports 86, ink supply pins 87, identification members 88*a* through 88*e* are provided on a wall body 81*b* of cartridge slots 89A through 89E. Second circuit substrates 310 are fixed to the wall body 81*b* of the cartridge slots 89A through 89. The second circuit substrates 310 are electrically connected to the first circuit substrates 300 (see, FIG. 16) which are provided in the ink cartridges 90.

The pairs of positioning pins 285*a*, 285*b* are provided on upper and lower portions in the cartridge slots 89A through 89E, respectively. The pairs of positioning pins 285*a*, 285*b* are members for positioning the ink cartridges 90.

The air communication ports 86 are provided to be close to the positioning pins 285*b* at lower sides in the cartridge slots 89A through 89E. The air communication ports 86 are ports for supplying the air to the pairs of positioning pins 285*a* located at an upper position and 285*b* located at a lower position, and the ink cartridges 90. Each pair of positioning pins 285*a*, 285*b* are inserted into positioning holes 298, 299 of each ink cartridge 90, respectively.

The ink supply pins 87 are provided to be close to the positioning pin 285*a* at upper sides in the cartridge slots 89A through 89E. The ink supply pins 87 are pins for supplying inks from the ink cartridges 90 to the liquid ejecting head 21*a* (see, FIG. 1) through the ink tubes 25 (see, FIG. 1).

The identification members 88*a* through 88*e* are provided in the cartridge slots 89A through 89E, respectively. The identification members 88*a* through 88*e* are provided at positions between the positioning pins 285*a* at the upper sides and the air communication ports 86. The identification members 88*a* through 88*e* are members for preventing the ink cartridges 90 from being mistakenly attached.

The second circuit substrates 310 are made to be in contact with the first circuit substrates 300 provided in the ink cartridges 90 so as to be electrically connected thereto when the ink cartridges 90 are attached to the cartridge slots 89A through 89E. Detailed configurations of the first circuit substrates 300 and the second circuit substrates 310 are described below.

Figure 16:
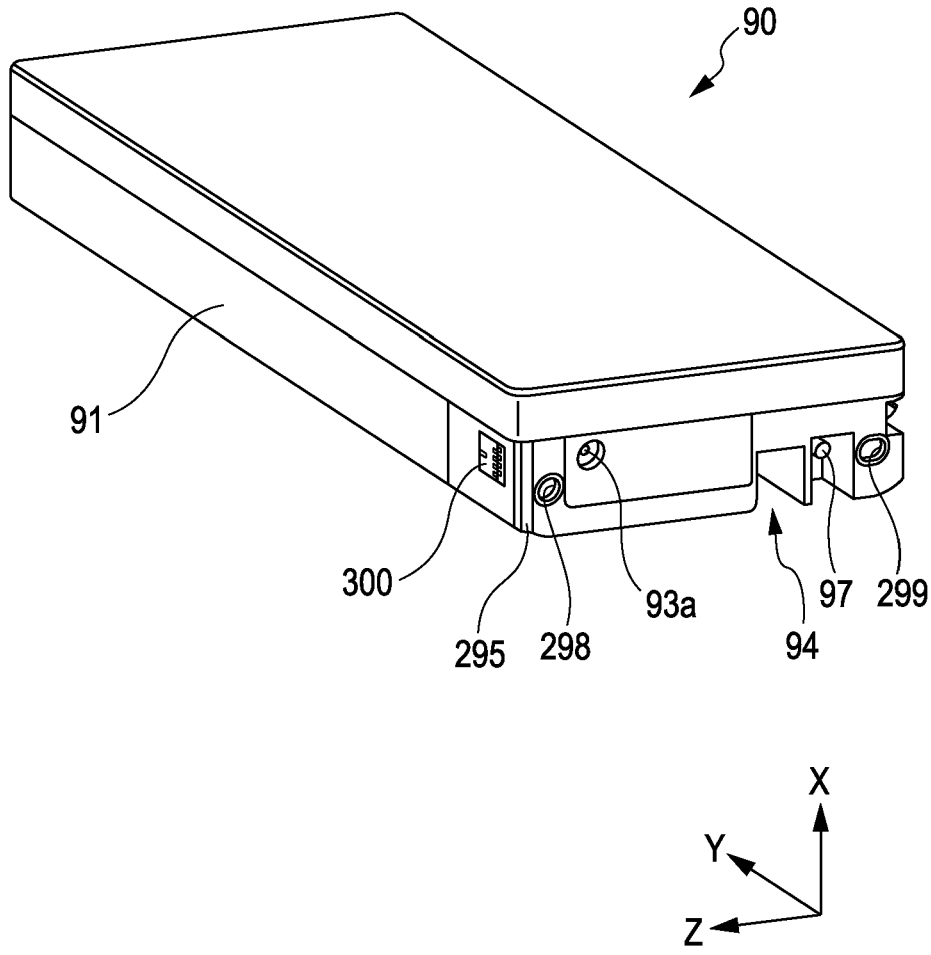
FIG. 16 is a perspective view illustrating a liquid accommodating container according to the third embodiment.
Figure 17:
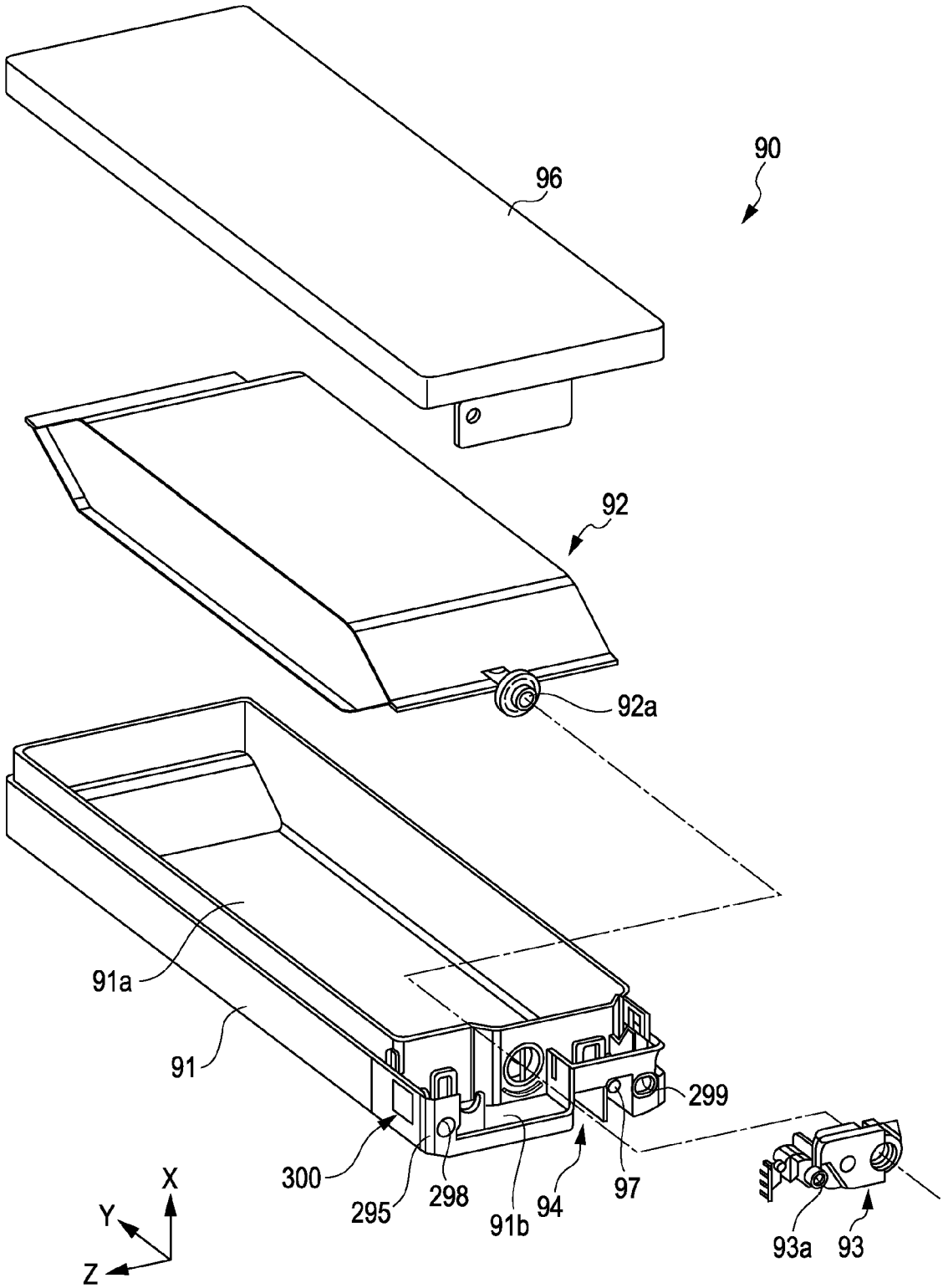
FIG. 17 is an exploded perspective view illustrating the liquid accommodating container according to the third embodiment.

FIG. 16 is a perspective view illustrating the ink cartridge 90. FIG. 17 is an exploded perspective view illustrating the ink cartridge 90 as illustrated in FIG. 16.

As illustrated in FIG. 16 and FIG. 17, each ink cartridge 90 includes a flattened ink cartridge main body (liquid accommodating container main body) 91 having a substantially rectangular parallelepiped shape, the first circuit substrate 300 and the movement member 295.

The pair of positioning holes 298, 299 are provided in a front face (face at the −Y direction side) of the ink cartridge 90 so as to be separated from each other.

Positioning by the positioning holes 298, 299 and the above pairs of positioning pins 285*a*, 285*b* is described. If the ink cartridges 90 are inserted into the cartridge slots 89A through 89E, front ends of the positioning pins 285*a*, 285*b* are fitted into the positioning holes 298, 299, respectively. Thereafter, if the ink cartridges 90 are further inserted to inner sides of the cartridge slots 89A through 89E, the ink cartridges 90 move based on the positioning pins 285*a*, 285*b*.

If the ink cartridges 90 are completely attached to the cartridge slots 89A through 89E, the positioning holes 298, 299 and the pairs of the positioning pins 285*a*, 285*b* are fitted, respectively. Thus, positions of the ink cartridges 90 in the direction along the front end faces thereof are determined so that the movements of the ink cartridges 90 are restricted.

Each of one positioning holes 298 is set to be a shape (circular) substantially corresponding to a cross-sectional shape perpendicular to an axial direction of the positioning pin 285*a* at the upper side. Each of the other positioning holes 299 is set to be a shape substantially corresponding to a cross-sectional shape perpendicular to an axial direction of the positioning pin 285*b* at the lower side. That is, the positioning hole 299 is set to be an elongated hole in the height direction (Z direction) of the ink cartridge main body 91. By setting each of the other positioning holes 299 to be an elongated hole in such a manner, a dimensional tolerance or the like can be easily allowed while keeping the positioning accuracy.

The first circuit substrate 300 is fixed to a side face (face at the +Z direction side) of the ink cartridge 90 (ink cartridge main body 91) along the attachment direction (−Y direction). In other words, the first circuit substrate 300 is fixed to a side face of the ink cartridge 90, which is in parallel with the attachment direction. It is to be noted that being in "parallel" with the attachment direction includes both of a case of being in perfectly parallel with the attachment direction and a case of being in substantially parallel with the attachment direction. The first circuit substrate 300 is provided at a position close to the movement member 295.

Figure 18:
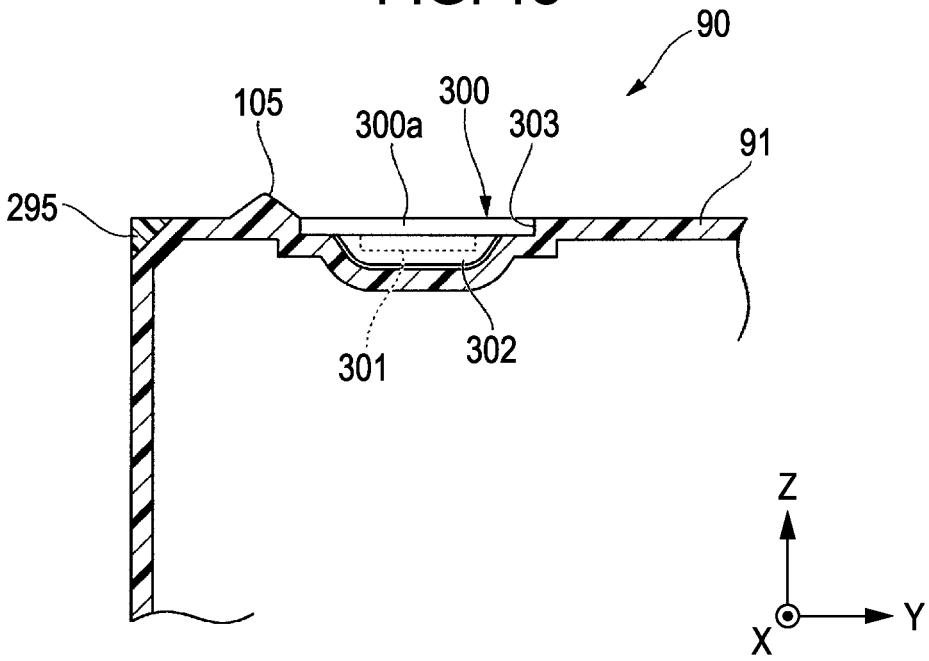
FIG. 18 is a schematic cross-sectional view illustrating a first circuit substrate and an attachment portion thereof according to the third embodiment.

FIG. 18 is a schematic cross-sectional view illustrating the first circuit substrate 300 and an attachment portion thereof. FIG. 18 illustrates a side end (end at the +Z direction side) of the ink cartridge 90, which is in parallel with the downstream side (−Y direction side) in the attachment direction.

As illustrated in FIG. 18, the first circuit substrate 300 is attached in a concave portion 303 formed at a side end (end at the +Z direction side) of the ink cartridge main body 91. Therefore, a position of the first circuit substrate 300 is defined. A first electrode pad 300*a* which is electrically connected to the first connector terminal 121 (see, FIG. 19), which will be described later, is formed in a surface (surface at the +Z direction side) of the first circuit substrate 300. The first electrode pad 300*a* is electrically connected to the above remaining amount detection sensor. A circuit pattern (not shown) is formed and electrically connected with the first electrode pad 300*a*. The circuit pattern is covered by a solder resist film (not shown), for example. A memory element 301 such as EEPROM is mounted on a rear face (face at the −Z direction) of the first circuit substrate 300. The memory element 301 is a member for recording pieces of information such as an ink remaining amount and a use history of the cartridge, for example. The memory element 301 is firmly fixed to the rear face of the first circuit substrate 300 with a mold resin 302.

The movement member 295 is provided in a corner portion of the ink cartridge main body 91 at the downstream side (at the −Y direction side) in the attachment direction. The movement member 295 moves the first connector terminal 121 (see, FIG. 19) from a position at which the first connector terminal 121 is separated from the first circuit substrate 300 to a position at which the first connector terminal 121 makes contact with the first circuit substrate 300 when the ink cartridge 90 is attached to the cartridge holder 80.

A projection portion 105 is formed between the first circuit substrate 300 and the movement member 295 on a side end of the ink cartridge main body 91 (end at the +Z direction side). The projection portion 105 is formed so as to project to a surface side (+Z direction side) of the first circuit substrate 300. The projection portion 105 functions for preventing the end (end at the −Y direction side) of the first circuit substrate 300 from making contact with the first connector terminal 121 (see, FIG. 19) which will be described later. To be more specific, when the substrate main body of the first circuit substrate 300 is formed with a glass epoxy material, if the first connector terminal 121 makes direct contact with the first circuit substrate 300, the following problem arises. That is, a problem that the end of the first circuit substrate 300 is chipped off or being the like and damaged is generated. Therefore, it is so configured that the end of the first circuit substrate 300 does not make contact with the first connector terminal 121.

The liquid ejecting system 1 according to the invention includes the first circuit substrates 300, the first connector terminals 121 and the movement members 295. The first circuit substrates 300 are fixed to side faces of the ink cartridge main bodies 91, which are in parallel with the attachment direction. The first connector terminals 121 are movably provided on a side face of the cartridge holder 80, which is in parallel with the attachment direction. The movement members 295 are provided in the ink cartridge main bodies 91 at the downstream side in the attachment direction. Then movement members 295 move the first connector terminals 121 from positions at which the first connector terminals 121 are separated from the first circuit substrate 300 to positions at which the first connector terminals 121 make contact with the first circuit substrate 300 when the ink cartridge main bodies 91 are attached to the cartridge holder 80. With this, an electrical conduction failure between the first circuit substrates 300 and the first connector terminals 121 is eliminated and a normal printing operation can be ensured in the liquid ejecting system 1. Hereinafter, the first connector terminal 121 and an attachment portion thereof are described in detail with reference to FIG. 19.

Figure 19:
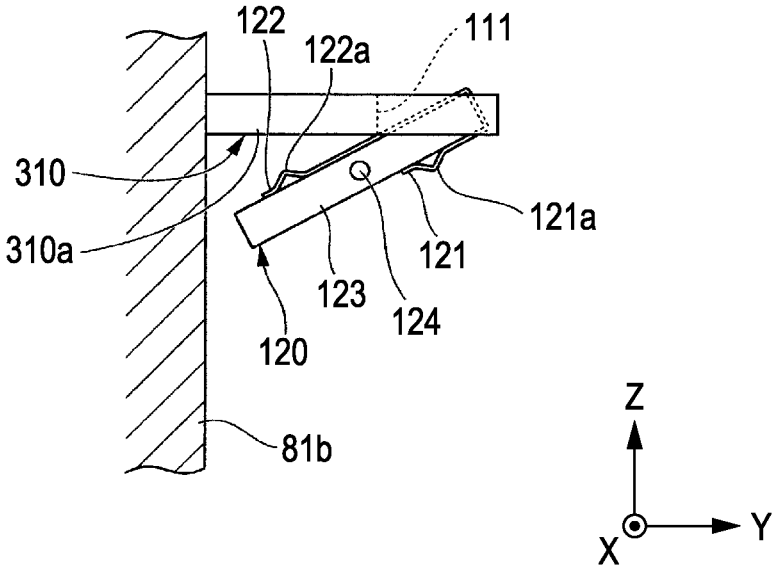
FIG. 19 is a schematic cross-sectional view illustrating a connector terminal and an attachment portion thereof according to the third embodiment.

FIG. 19 is a schematic cross-sectional view illustrating the first connector terminal 121 and the attachment portion thereof. FIG. 19 illustrates a side end (end at the −Z direction side) of the cartridge holder 80, which is in parallel with the downstream side (−Y direction side) in the attachment direction.

As illustrated in FIG. 19, the first connector terminal 121 is movably provided on a side face of the cartridge holder 80, which is in parallel with the attachment direction. To be more specific, the first connector terminal 121 is provided on a face (face at the −Z direction side) of a rotational substrate 123 at the upstream side (+Y direction side) with respect to a supporting shaft 124 in the attachment direction. The rotational substrate 123 constitutes a rotational member 120 which rotationally moves about the supporting shaft 124 as a center axis. The first connector terminal 121 rotationally operates from a state where a surface which makes contact with the first circuit substrate 300 is tilted with respect to the attachment direction (−Y direction) to a state where the surface is in parallel with the attachment direction when the ink cartridge 90 is attached to the cartridge holder 80.

The first connector terminal 121 is formed with an elastic metal material such as copper. A first contact portion 121*a* which is electrically connected to the first electrode pad 300*a* of the first circuit substrate 300 is formed on a surface (surface at the −Z direction side) of the first connector terminal 121. The first contact portion 121*a* is provided at a position corresponding to the first electrode pad 300*a*. The supporting shaft 124 is a bar-shaped member extended in the X direction and is positioned at a center portion of the rotational substrate 123. Both ends of the supporting shaft 124 are fixed to the cartridge holder 80.

The second circuit substrate 310 is fixed to a side face of the cartridge holder 80, which is in parallel with the attachment direction. To be more specific, a base end of the second circuit substrate 310 is supported by and fixed to a face of the wall body 81*b* on the +Y direction side. An opening 111 is formed in the second circuit substrate 310 at the +Y direction side. Therefore, the rotational member 120 can freely rotationally move from a state where the rotational member 120 is tilted with respect to the attachment direction at a predetermined angle to a state where the rotational member 120 is in parallel with the attachment direction. A second electrode pad 310*a* which is electrically connected to a second connector terminal 122, which will be described later, is formed on a surface (surface at the −Z direction side) of the second circuit substrate 310.

The second connector terminal 122 is movably provided on a side face of the cartridge holder 80, which is in parallel with the attachment direction, and electrically connected with the first connector terminal 121. The second connector terminal 122 moves from a position at which the second connector terminal 122 is separated from the second circuit substrate 310 to a position at which the second connector terminal 122 makes contact with the second circuit substrate 310 at the following timing. That is, the second connector terminal 122 moves as described above when the first connector terminal 121 moves from a position at which the first connector terminal 121 is separated from the first circuit substrate 300 to a position at which the first connector terminal 121 makes contact with the first circuit substrate 300, when the ink cartridge 90 is attached to the cartridge holder 80.

To be more specific, the second connector terminal 122 is provided on the other surface (surface at the +Z direction side) of the rotational substrate 123 at the downstream side (at the −Y direction side) with respect to the supporting shaft 124 in the attachment direction. The second connector terminal 122 rotationally operates from a state where a surface which makes contact with the second circuit substrate 310 is tilted with respect to the attachment direction (−Y direction) to a state where the surface is in parallel with the attachment direction when the ink cartridge 90 is attached to the cartridge holder 80.

The second connector terminal 122 is formed with an elastic metal material such as copper like the first connector terminal 121. The second connector terminal 122 is arranged so as to correspond to the second electrode pad 310*a* of the second circuit substrate 310. A second contact portion 122*a* which is electrically connected to the second electrode pad 310*a* of the second circuit substrate 310 is formed on a surface (surface at the +Z direction side) of the second connector terminal 122. The second contact portion 122*a* is provided at a position corresponding to the second electrode pad 310*a*.

With such a configuration, when the ink cartridge 90 is attached to the cartridge holder 80, the first electrode pad 300*a* of the first circuit substrate 300 makes contact with the first contact portion 121*a* of the first connector terminal 121. In the same manner, the second electrode pad 310*a* of the second circuit substrate 310 makes contact with the second contact portion 122*a* of the second connector terminal 122. Thus, a memory element 301 and a remaining amount detection sensor are electrically connected to a control circuit in the printer main body 2 through the first circuit substrate 300. This makes it possible to control operations of the memory element 301 and a remaining amount detection sensor from the side of the printer main body 2.

Figure 20A:
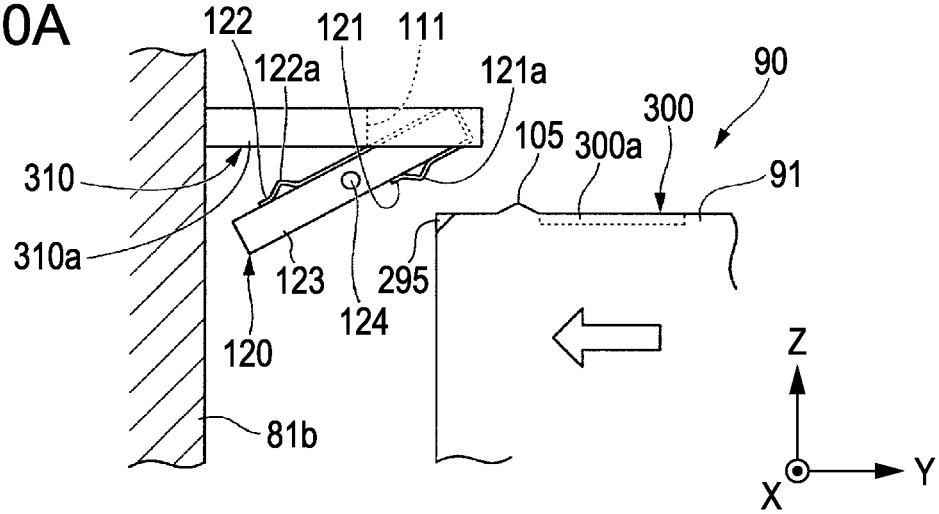
FIGS. 20A through 20C are schematic cross-sectional views illustrating a moving state of the connector terminal according to the third embodiment.
Figure 20B:
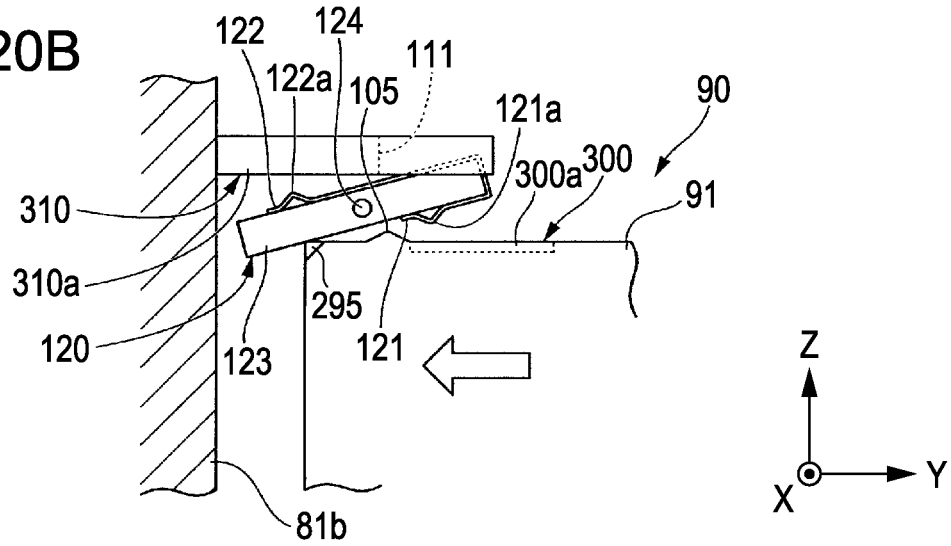
Figure 20C:
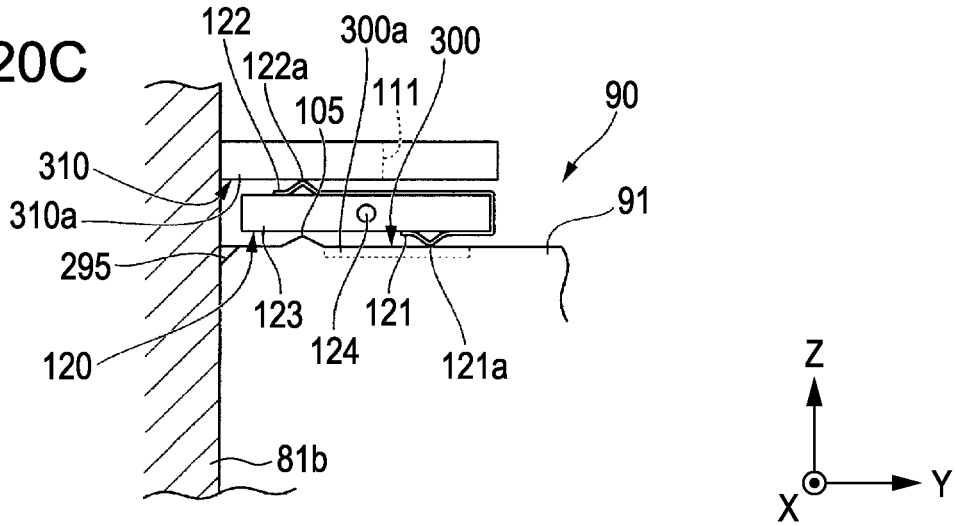

FIGS. 20A through 20C are schematic cross-sectional views illustrating a moving state of the connector terminals 121, 122 in the third embodiment. FIG. 20A is a view illustrating a state before the ink cartridge 90 is attached to the cartridge holder 80. FIG. 20B is a view illustrating a state when the ink cartridge 90 is being attached to the cartridge holder 80. FIG. 20C is a view illustrating a state after the ink cartridge 90 is completely attached to the cartridge holder 80.

When the ink cartridge 90 is attached to the cartridge holder 80, the first connector terminal 121 is moved from a position at which the first connector terminal 121 is separated from the first circuit substrate 300 to a position at which the first connector terminal 121 makes contact with the first circuit substrate 300. At the same time, the second connector terminal 122 is moved from a position at which the second connector terminal 122 is separated from the second circuit substrate 310 to a position at which the second connector terminal 122 makes contact with the second circuit substrate 310. Hereinafter, moving states of the movement member 295 and the rotational member 120 will be described.

At first, as illustrated in FIG. 20A, a state before the ink cartridge 90 is attached to the cartridge holder 80, that is, a state before the movement member 295 makes contact with the rotational member 120 is considered. In this case, the rotational member 120 is tilted with respect to the attachment direction at a predetermined angle. To be more specific, a posture of the rotational member 120 is held by a holding member (not shown) such as a stopper in a state where an end thereof (end at the +Y direction side) gets into the opening 111. The movement member 295 is positioned at a lower side (−Z direction side) with respect to the supporting shaft 124 of the rotational member 120. The projection portion 105 is separated from the first contact portion 121*a* of the first connector terminal 121 by a predetermined distance.

Next, as illustrated in FIG. 20B, a state when the ink cartridge 90 is being attached to the cartridge holder 80, that is, a state when the movement member 295 makes contact with the rotational member 120 to move the rotational member 120 is considered. The movement member 295 is positioned at a lower side (−Z direction side) with respect to the supporting shaft 124 of the rotational member 120 in a state before the ink cartridge 90 is attached to the cartridge holder 80. Therefore, if the movement member 295 makes contact with a lower side of the rotational member 120 and moves in the attachment direction, the rotational member 120 rotationally moves about the supporting shaft 124 in the clockwise direction. That is to say, the rotational member 120 rotationally moves from a state where the rotational member 120 is tilted with respect to the attachment direction at a predetermined angle to a state such that an angle gradient thereof becomes smaller.

The projection portion 105 is separated from the first contact portion 121*a* by a predetermined distance in a state before the ink cartridge 90 is attached to the cartridge holder 80. Therefore, the projection portion 105 does not make contact with any portions during the movement of the movement member 295. Further, the first contact portion 121*a* does not make contact with any portions until the first contact portion 121*a* makes contact with the electrode pad 300*a*.

Therefore, even when there are dusts on a slide contact path as in the existing technique, a problem that the dusts adhere to the connector terminal and get into between the circuit substrate and the connector terminal is not generated. Further, even when a projection portion is formed on an attachment portion of the circuit substrate, a problem that a surface of the projection portion is rubbed with the connector terminal and the material of the projection portion is scratched off does not occur.

As illustrated in FIG. 20C, a state after the ink cartridge 90 is completely attached to the cartridge holder 80 will be considered. In this case, the rotational member 120 is in parallel with the attachment direction. That is, the first electrode pad 300*a* of the first circuit substrate 300 makes contact with the first contact portion 121*a* of the first connector terminal 121. In the same manner, the second electrode pad 310*a* of the second circuit substrate 310 makes contact with the second contact portion 122*a* of the second connector terminal 122. Thus, the memory element 301 and the remaining amount detection sensor are electrically connected to the control circuit in the printer main body 2 through the first circuit substrate 300. This makes it possible to control operations of the memory element 301 and the remaining amount detection sensor from the side of the printer main body 2.

With the liquid ejecting system 1 according to the embodiment, when the ink cartridge 90 is attached to the cartridge holder 80, the movement of the movement member 295 in the attachment direction makes the connector terminal 121 move from a position at which the connector terminal 121 is separated from the first circuit substrate 300 to a position at which the connector terminal 121 makes contact with the first circuit substrate 300. Therefore, the first connector terminal 121 can be made not to be in contact with any portions until the first connector terminal 121 makes contact with the first circuit substrate 300. Therefore, even when there are dusts on a slide contact path as in the existing technique, a problem that the dusts adhere to the connector terminal and get into between the circuit substrate and the connector terminal is not generated. Further, even when a projection portion is formed on an attachment portion of the circuit substrate, a problem that a surface of the projection portion is rubbed with the connector terminal and the material of the projection portion is scratched off is not generated. Accordingly, the liquid ejecting system 1 which eliminates an electrical conduction failure between the first circuit substrate 300 and the first connector terminal 121 and can ensure a normal printing operation can be provided.

With this configuration, when the ink cartridge 90 is attached to the cartridge holder 80, the first connector terminal 121 rotationally operates from a state where the first connector terminal 121 is tilted with respect to the attachment direction at a predetermined angle to a state where the first connector terminal 121 is in parallel with the attachment direction. Therefore, a rotational movement mechanism of the first connector terminal 121 is easily accommodated in the cartridge holder 80. To be more specific, a moving space of the first connector terminal 121 can be made smaller in comparison with a case where the first connector terminal 121 is not rotationally operated (for example, a configuration in which the first connector terminal 121 is moved in a slide manner). Therefore, a space for providing a slide mechanism is not required to be provided. This makes it possible to suppress an apparatus from being increased in size.

With this configuration, when the ink cartridge 90 is attached to the cartridge holder 80, and when the first connector terminal 121 is moved by the movement of the movement member 295 in the attachment direction, the second connector terminal 122 is moved from a position at which the second connector terminal 122 is separated from the second circuit substrate 310 to a position at which the second connector terminal 122 makes contact with the second circuit substrate 310. Therefore, the second connector terminal 122 can be made not to be in contact with any portions until the second connector terminal 122 makes contact with the second circuit substrate 310. Accordingly, the liquid ejecting system 1 which eliminates an electrical conduction failure between the second circuit substrate 310 and the second connector terminal 122 and can ensure a normal printing operation can be provided.

With the printer main body 2 according to the embodiment, the first connector terminal 121 can be made not to be in contact with any portions until the first connector terminal 121 makes contact with the ink cartridge 90 since the printer main body 2 is used in the above liquid ejecting system 1. Accordingly, the printer main body 2 which eliminates an electrical conduction failure in the first connector terminal 121 and can ensure a normal printing operation can be provided.

With the ink cartridge 90 according to the embodiment, the first connector terminal 121 can be made not to be in contact with any portions until the first connector terminal 121 makes contact with the first circuit substrate 300 since the ink cartridge 90 is used in the above liquid ejecting system 1. Accordingly, the ink cartridge 90 which eliminates an electrical conduction failure between the first circuit substrate 300 and the first connector terminal 121 and can ensure a normal printing operation can be provided.

In the embodiment, the movement member 295 makes contact with the rotational member 120 so as to move the rotational member 120. However, the configuration is not limited thereto. For example, the movement member 295 may move the rotational member 120 without making contact with the rotational member 120. To be more specific, magnetic members such as magnets are used for the movement member 295 and the rotational member 120 so that the rotational member 120 can be moved with a magnetic force generated between the movement member 295 and the rotational member 120 even in a case where the movement member 295 and the rotational member 120 are separated from each other.

At this time, a force attracting each other may act between the movement member 295 and the rotational member 120 (for example, magnets having polarities opposite to each other may be used). Alternatively, a force repelling each other may act between the movement member 295 and the rotational member 120 (for example, magnets having the same polarity may be used). When the force attracting each other acts between the movement member 295 and the rotational member 120, a magnetic member is arranged at the side at which the first connector terminal 121 of the rotational member 120 is arranged (right side (+Y direction side) with respect to the supporting shaft 124). When the force repelling each other acts between the movement member 295 and the rotational member 120, a magnetic member is arranged at an opposite side to the side at which the first connector terminal 121 of the rotational member 120 is arranged (left side (−Y direction side) with respect to the supporting shaft 124). Thus, a magnetic force is required to act such that the first connector terminal 121 is made closer to the first circuit substrate 300.

In the embodiment, the first circuit substrate 300 is attached to an end of the ink cartridge main body 91 at the +Z direction side. However, the configuration is not limited thereto. For example, the first circuit substrate 300 may be attached to an end of the ink cartridge main body 91 at the −Z direction side or attached to an end of the ink cartridge main body 91 at the +X direction side or an end thereof at the −X direction side. That is to say, it is sufficient that the first circuit substrate 300 is fixed on a side face of the ink cartridge main body 91, which is in parallel with the attachment direction.

In the embodiment, a base end of the second circuit substrate 310 is supported by and fixed to a face of the wall body 81*b* on the +Y direction side. However, the configuration is not limited thereto. For example, a rear face of the second circuit substrate 310 (face opposite to the side at which the second electrode pad 310*a* is formed) may be supported by a face of the ceiling plate 81*c* at the −Z direction side. That is to say, it is sufficient that the second circuit substrate 310 is arranged at a position corresponding to the position at which the first circuit substrate 300 is arranged and fixed to a side face of the cartridge holder 80, which is in parallel with the attachment direction.

In the embodiment, the first contact portion 121*a* of the first connector terminal 121 provided on the rotational member 120 is arranged at the same position in the attachment direction (one position when viewed with a cross section) and the first connector terminal 121 and the first circuit substrate 300 are electrically conducted to each other at one location. However, the configuration is not limited thereto. Hereinafter, an electrical conduction mechanism between the first connector terminal and the first circuit substrate, which is different from that in the embodiment, is described with reference to FIGS. 21A and 21B and FIG. 22.

Fourth Embodiment

Figure 21A:
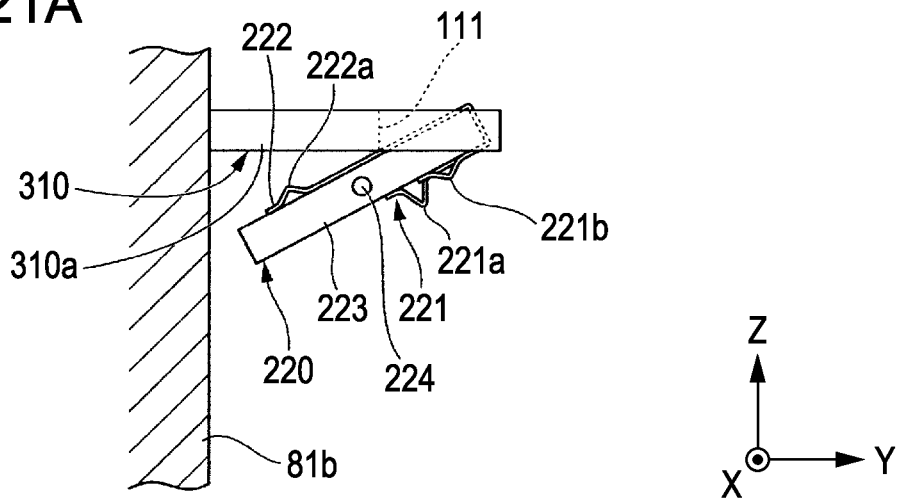
FIGS. 21A and 21B are schematic views illustrating a connector terminal and an attachment portion thereof according to a fourth embodiment.
Figure 21B:
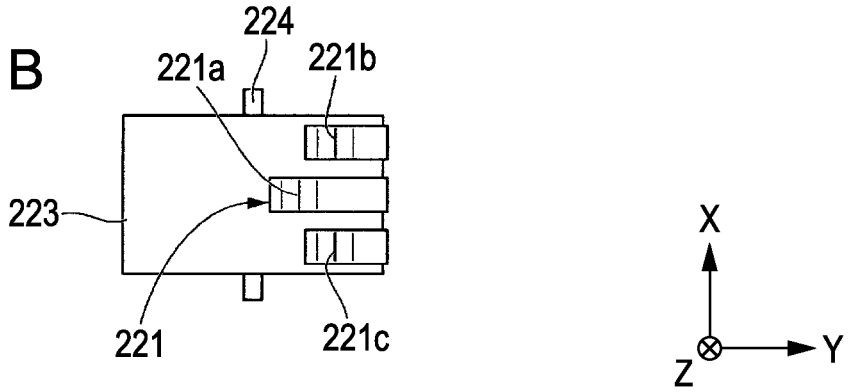
Figure 22:
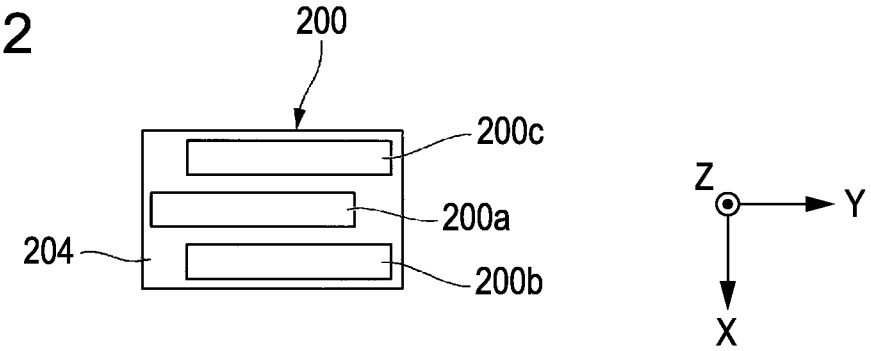
FIG. 22 is a schematic plan view illustrating a first circuit substrate according to the fourth embodiment.

FIGS. 21A and 21B are schematic views illustrating a connector terminal and an attachment portion thereof according to the fourth embodiment. FIG. 22 is a schematic plan view illustrating a first circuit substrate according to the fourth embodiment. FIG. 21A corresponds to FIG. 19 and illustrates a side end (end at the −Z direction side) of the cartridge holder 80, which is in parallel with the downstream side (−Y direction side) in the attachment direction. FIG. 21B is a plan view illustrating a rotational member 220 according to the fourth embodiment when seen from the side at which a first connector terminal 221 is arranged (−Z direction side). In the embodiment, the first connector terminal 221 is different from the first connector terminal 121 according to the third embodiment in a point that a plurality of contact portions arranged at positions which are different from each other in the attachment direction are included. In FIGS. 21A and 21B, the same reference numerals denote the same components as those in FIG. 19 and detailed description thereof is not repeated.

As illustrated in FIGS. 21A and 21B, the first connector terminal 221 is movably provided on a side face of the cartridge holder 80, which is in parallel with the attachment direction. To be more specific, the first connector terminal 221 is provided on a face (face at the −Z direction side) of a rotational substrate 223 at the upstream side (+Y direction side) with respect to a supporting shaft 224 in the attachment direction. The rotational substrate 223 constitutes the rotational member 220 which rotationally operates about the supporting shaft 224 as a center axis. The first connector terminal 221 rotationally moves from a state where a surface which makes contact with a first circuit substrate 200 (see, FIG. 22) is tilted with respect to the attachment direction (−Y direction) to a state where the surface is in parallel with the attachment direction when the ink cartridge 90 is attached to the cartridge holder 80.

A downstream side contact portion 221*a* and upstream side contact portions 221*b*, 221*c* are formed on a surface of the first connector terminal 221 (surface at the −Z direction side). The downstream side contact portion 221*a* is positioned at the downstream side in the attachment direction. The upstream side contact portions 221*b*, 221*c* are positioned at the upstream side in the attachment direction. A total of three contact portions including one downstream side contact portion 221*a* and two upstream side contact portions 221*b*, 221*c* positioned at the upstream side in the attachment direction are formed on the first connector terminal 221. The height of the downstream side contact portion 221*a* is higher than the heights of the upstream side contact portions 221*b*, 221*c*. The height of the downstream side contact portion 221*a* indicates a distance from a surface of the rotational member 220 to a top of the downstream side contact portion 221*a*. The heights of the upstream side contact portions 221*b*, 221*c* indicate distances from a surface of the rotational member 220 to tops of the upstream side contact portions 221*b*, 221*c*, respectively. The first connector terminal 221 is formed with an elastic metal material such as copper as in the above first connector terminal 121.

As illustrated in FIG. 22, the first circuit substrate 200 includes a downstream side electrode pad 200*a* which is positioned at the downstream side in the attachment direction and upstream side electrode pads 200*b*, 200*c* which are positioned at the upstream side in the attachment direction. The first circuit substrate 200 includes a total of three electrode pads including one downstream side electrode pad 200*a* and two upstream side electrode pads 200*b*, 200*c*. Each of the electrode pads 200*a*, 200*b*, 200*c* is electrically connected to a remaining amount detection sensor. A circuit pattern (not shown) is formed and electrically connected with the electrode pads 200*a*, 200*b*, 200*c*. The circuit pattern is covered by a solder resist film 204, for example.

Thus, the downstream side contact portion 221*a* which is electrically connected to the downstream side electrode pad 200*a*, the upstream side contact portion 221*b* which is electrically connected to the upstream side electrode pad 200*b* and the upstream side contact portion 221*c* which is electrically connected to the upstream side electrode pad 200*c* are formed on the surface (surface at the −Z direction side) of the first connector terminal 221. Note that the downstream side electrode pad 200*a*, the upstream side electrode pad 200*b*, and the upstream side electrode pad 200*c* are provided in the first circuit substrate 200. The contact portions 221*a*, 221*b*, 221*c* are provided at positions corresponding to the electrode pads 200*a*, 200*b*, 200*c*, respectively.

A second circuit substrate 310 is fixed to a side face of the cartridge holder 80, which is in parallel with the attachment direction. An opening 111 is formed in the second circuit substrate 310 at the +Y direction side. A second electrode pad 310*a* which is electrically connected to a second connector terminal 222 is formed on a surface of the second circuit substrate 310 (surface at the −Z direction side).

The second connector terminal 222 is movably provided on a side face of the cartridge holder 80, which is in parallel with the attachment direction, and electrically connected with the first connector terminal 221. The second connector terminal 222 moves from a position at which the second connector terminal 222 is separated from the second circuit substrate 310 to a position at which the second connector terminal 222 makes contact with the second circuit substrate 310 at the following timing. That is, the second connector terminal 222 moves as described above when the first connector terminal 221 moves from a position at which the first connector terminal 221 is separated from the first circuit substrate 200 to a position at which the first connector terminal 221 makes contact with the first circuit substrate 200 when the ink cartridge 90 is attached to the cartridge holder 80.

The second connector terminal 222 is formed with an elastic metal material such as copper like the first connector terminal 221. The second connector terminal 222 is arranged so as to correspond to the second electrode pad 310*a* of the second circuit substrate 310. A second contact portion 222*a* which is electrically connected to the second electrode pad 310*a* of the second circuit substrate 310 is formed on a surface (surface at the +Z direction side) of the second connector terminal 222. The second contact portion 222*a* is provided at a position corresponding to the second electrode pad 310*a*.

With this configuration, when the ink cartridge 90 is attached to the cartridge holder 80, at first, the downstream side electrode pad 200*a* of the first circuit substrate 200 makes contact with the downstream side contact portion 221*a* of the first connector terminal 221. Then, the upstream side electrode pads 200*b*, 200*c* of the first circuit substrate 200 make contact with the upstream side contact portions 221*b*, 221*c* of the first connector terminal 221. In the same manner, the second electrode pad 310*a* of the second circuit substrate 310 makes contact with the second contact portion 222*a* of the second connector terminal 222. Therefore, a memory element and a remaining amount detection sensor are electrically connected to a control circuit in the printer main body 2 through the first circuit substrate 200. This makes it possible to control operations of the memory element and the remaining amount detection sensor from the side of the printer main body 2.

Figure 23A:
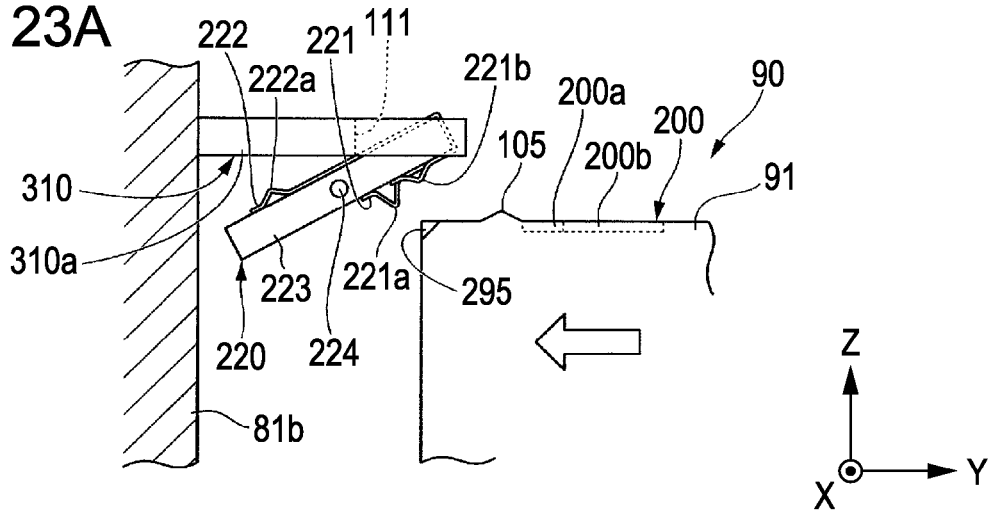
FIGS. 23A through 23C are schematic cross-sectional views illustrating a moving state of the connector terminal according to the fourth embodiment.
Figure 23B:
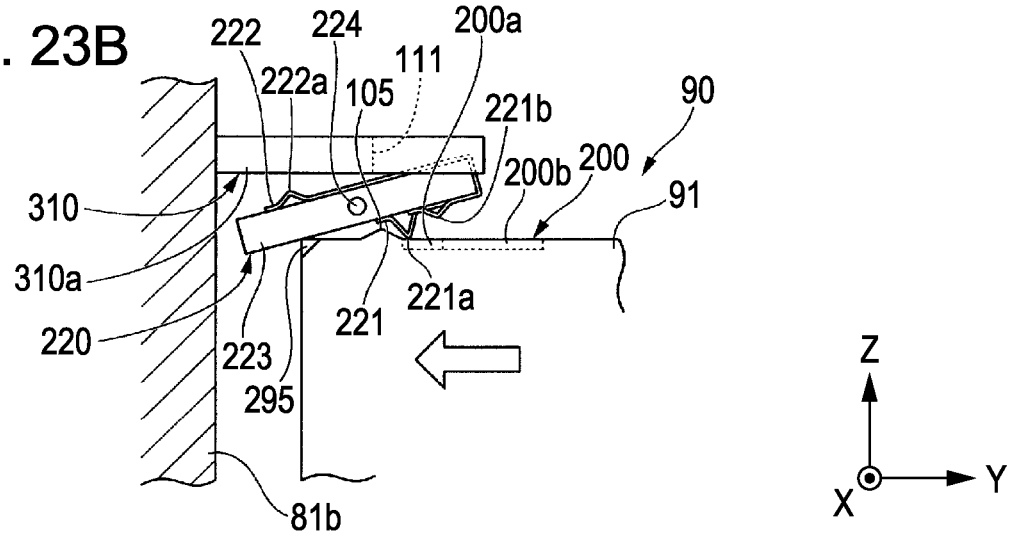
Figure 23C:
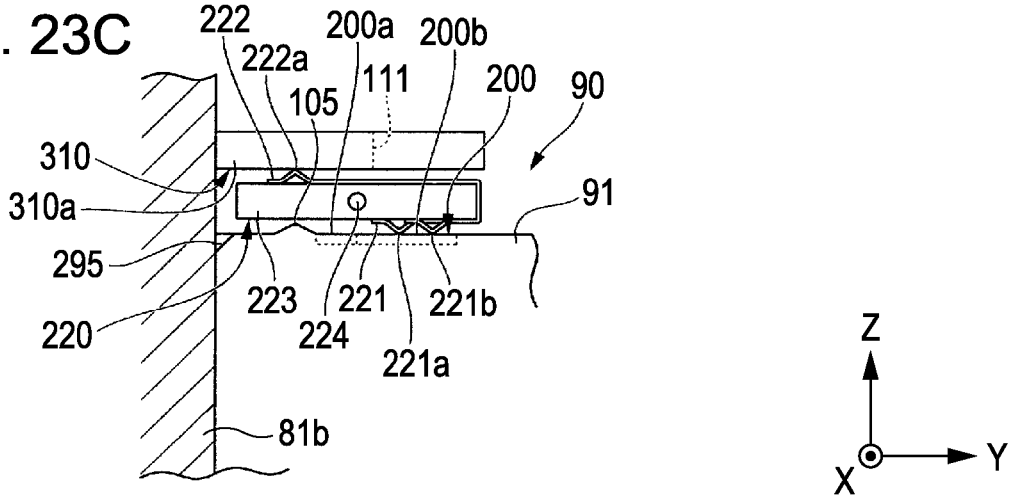

FIGS. 23A through 23C are schematic cross-sectional views illustrating moving states of the connector terminals 221, 222 according to the fourth embodiment. FIG. 23A corresponds to FIG. 20A and is a view illustrating a state before the ink cartridge 90 is attached to the cartridge holder 80. FIG. 23B corresponds to FIG. 20B and is a view illustrating a state when the ink cartridge 90 is being attached to the cartridge holder 80. FIG. 23C corresponds to FIG. 20C and is a view illustrating a state after the ink cartridge 90 is completely attached to the cartridge holder 80.

When the ink cartridge 90 is attached to the cartridge holder 80, the first connector terminal 221 is moved from a position at which the first connector terminal 221 is separated from the first circuit substrate 200 to a position at which the first connector terminal 221 makes contact with the first circuit substrate 200. At the same time, the second connector terminal 222 is moved from a position at which the second connector terminal 222 is separated from the second circuit substrate 310 to a position at which the second connector terminal 222 makes contact with second circuit substrate 310. Moving states of the movement member 295 and the rotational member 220 will be described next.

At first, as illustrated in FIG. 23A, a state before the ink cartridge 90 is attached to the cartridge holder 80, that is, a state before the movement member 295 makes contact with the rotational member 220 is considered. In this case, the rotational member 220 is tilted with respect to the attachment direction at a predetermined angle. The movement member 295 is positioned at a lower side (−Z direction side) with respect to the supporting shaft 224 of the rotational member 220. The projection portion 105 is separated from the downstream side contact portion 221*a* of the first connector terminal 221 by a predetermined distance.

Next, as illustrated in FIG. 23B, a state when the ink cartridge 90 is being attached to the cartridge holder 80, that is, a state when the movement member 295 makes contact with the rotational member 220 to move the rotational member 220 is considered. The movement member 295 is positioned at a lower side (−Z direction side) with respect to the supporting shaft 224 of the rotational member 220 in a state before the ink cartridge 90 is attached to the cartridge holder 80. Therefore, if the movement member 295 makes contact with a lower side of the rotational member 220 and moves in the attachment direction, the rotational member 220 rotationally moves about the supporting shaft 224 in the clockwise direction. That is to say, the rotational member 220 rotationally moves from a state where the rotational member 220 is tilted with respect to the attachment direction at a predetermined angle to a state such that an angle gradient thereof becomes smaller.

The projection portion 105 is separated from the downstream side contact portion 221*a* by a predetermined distance in a state before the ink cartridge 90 is attached to the cartridge holder 80. Therefore, the projection portion 105 does not make contact with any portions during the movement of the movement member 295. Further, the downstream side contact portion 221*a* does not make contact with any portions until the downstream side contact portion 221*a* makes contact with the downstream side electrode pad 200*a*.

The height of the downstream side contact portion 221*a* is higher than the heights of the upstream side contact portions 221*b*, 221*c*. Therefore, the downstream side contact portion 221*a* makes contact with the first circuit substrate 200 (downstream side electrode pad 200*a*) earlier than the upstream side contact portions 221*b*, 221*c* during the movement of the movement member 295.

Therefore, the downstream side contact portion 221*a* can be made to be into electrically contact with the downstream side electrode pad 200*a* during the attachment before the ink cartridge 90 is completely attached to the cartridge holder 80. Accordingly, a memory element and a remaining amount detection sensor are electrically connected to a control circuit in the printer main body 2 through the first circuit substrate 20 during the attachment. Accordingly, for example, pieces of information including an ink remaining amount, an ink expiration date, and adequacy of the ink cartridge 90 can be previously checked during the attachment.

As illustrated in FIG. 23C, a state after the ink cartridge 90 is completely attached to the cartridge holder 80 is considered. In this case, the rotational member 220 is in parallel with the attachment direction. That is to say, the downstream side electrode pad 200*a* of the first circuit substrate 200 makes contact with the downstream side contact portion 221*a* of the first connector terminal 221. The upstream side electrode pads 200*b*, 200*c* make contact with the upstream side contact portions 221*b*, 221*c*. At this time, the height of the downstream side contact portion 221*a* is substantially the same as the heights of the upstream side contact portions 221*b*, 221*c*. This is because the first connector terminal 221 is formed with an elastic metal material. In the same manner, the second electrode pad 310*a* of the second circuit substrate 310 makes contact with the second contact portion 222*a* of the second connector terminal 222. Therefore, a memory element and a remaining amount detection sensor are electrically connected to a control circuit in the printer main body 2 through the first circuit substrate 200. This makes it possible to control operations of the memory element and the remaining amount detection sensor from the side of the printer main body 2.

With the liquid ejecting system 1 according to the embodiment, a plurality of contact portions 221*a*, 221*b*, 221*c* are formed on the first connector terminal 221 at positions which are different from each other in the attachment direction. Therefore, when the ink cartridge 90 is attached to the cartridge holder 80, each of the contact portions 221*a*, 221*b*, 221*c* makes contact with the first circuit substrate 200 with a time interval. To be more specific, at first, the downstream side contact portion 221*a* and the downstream side electrode pad 200*a*, which are provided so as to correspond to each other at the downstream side in the attachment direction, make contact with each other. Subsequently, the upstream side contact portions 221*b*, 221*c* and the upstream side electrode pads 200*b*, 200*c* make contact with each other, respectively. Therefore, before the ink cartridge 90 is completely attached to the cartridge holder 80, various pieces of information (for example, an ink remaining amount, an ink expiration date, and adequacy of the ink cartridge 90) corresponding to each of the contact portions 221*a*, 221*b*, 221*c* can be previously acquired.

In the above embodiment, the posture of the rotational member is held by a holding member (not shown) such as a stopper in a state where an end thereof (end at the +Y direction side) gets into the opening portion. However, the configuration is not limited thereto. Hereinafter, a holding mechanism of the rotational member which is different from that in the above embodiment is described with reference to FIGS. 24A and 24B.

Fifth Embodiment

Figure 24A:
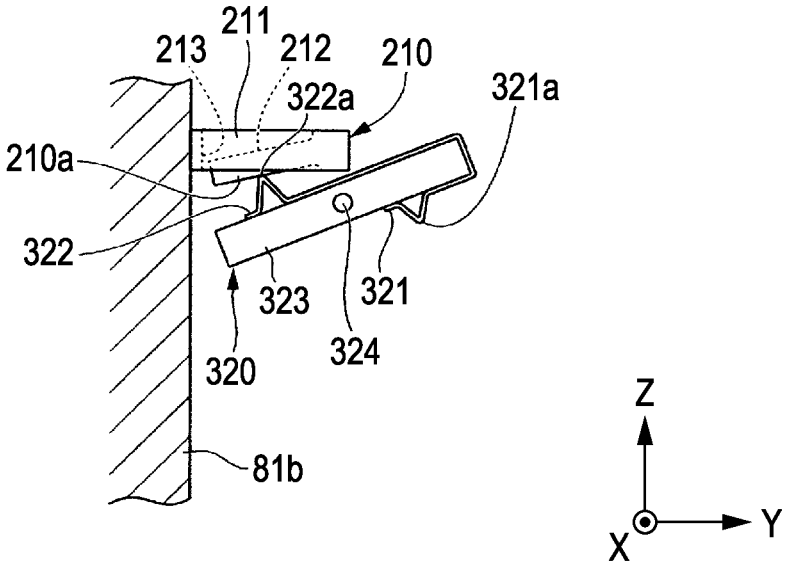
FIGS. 24A and 24B are schematic views illustrating a connector terminal and an attachment portion thereof according to a fifth embodiment.
Figure 24B:
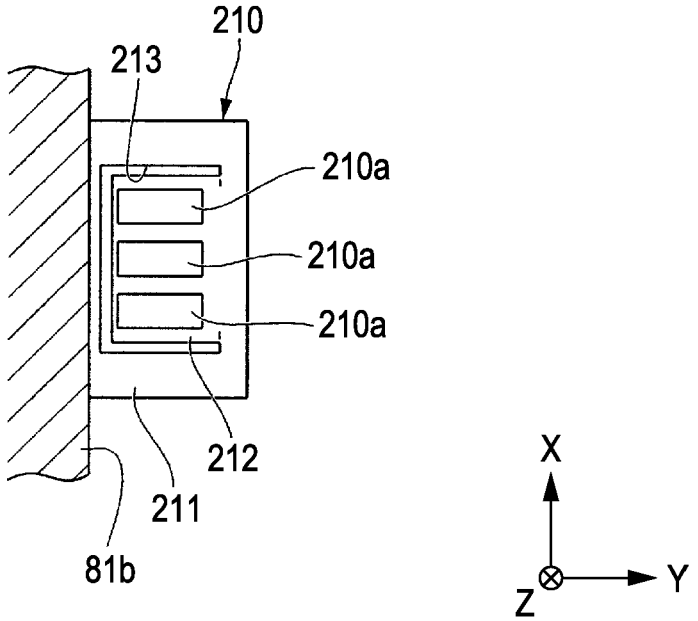

FIGS. 24A and 24B are schematic views illustrating a connector terminal and an attachment portion thereof according to the fifth embodiment. FIG. 24A corresponds to FIG. 19 and illustrates a side end (end at the −Z direction side) of the cartridge holder 80, which is in parallel with the downstream side (−Y direction side) in the attachment direction. FIG. 24B is a plan view illustrating a second circuit substrate 210 according to the fifth embodiment when seen from the side (−Z direction side) at which second electrode pads 210*a* are arranged. In the embodiment, the second circuit substrate 210 is different from the second circuit substrate 310 according to the third embodiment in a point that the second circuit substrate 210 has a function as a stopper which holds the posture of a rotational member. In FIGS. 24A and 24B, the same reference numerals denote the same components as those in FIG. 19 and detailed description thereof is not repeated.

As illustrated in FIGS. 24A and 24B, a first connector terminal 321 is movably provided on a side face of the cartridge holder 80, which is in parallel with the attachment direction. To be more specific, the first connector terminal 321 is provided on a face (face at the −Z direction side) of a rotational substrate 323 at the upstream side (+Y direction side) with respect to a supporting shaft 324 in the attachment direction. The rotational substrate 323 constitutes a rotational member 320 which rotationally operates about the supporting shaft 324 as a center axis. The first connector terminal 321 rotationally operates from a state where a surface which makes contact with the first circuit substrate 300 (see, FIG. 25) is tilted with respect to the attachment direction (−Y direction) to a state where the surface is in parallel with the attachment direction when the ink cartridge 90 is attached to the cartridge holder 80.

The first connector terminal 321 is formed with an elastic metal material such as copper. A first contact portion 321*a* which is electrically connected to a first electrode pad 300*a* of a first circuit substrate 300 is formed on a surface (surface at the −Z direction side) of the first connector terminal 321. The first contact portion 321*a* is provided at a position corresponding to the first electrode pad 300*a*. The supporting shaft 324 is a bar-shaped member extended in the X direction and is positioned at a center portion of the rotational substrate 323. Both ends of the supporting shaft 324 are fixed to the cartridge holder 80.

The second circuit substrate 210 is fixed to a side face of the cartridge holder 80, which is in parallel with the attachment direction. To be more specific, the second circuit substrate 210 includes a stopper portion 212 which holds a posture of the rotational member 320 and a supporting portion 211 which supports the stopper portion 212. A U-shaped groove 213 is formed between the stopper portion 212 and the supporting portion 211. The stopper portion 212 can be elastically deformed based on a base end (end at the downstream side in the attachment direction) of the groove 213. The second circuit substrate 210 is formed with an elastic insulating material, for example. The second electrode pads 210*a* which are electrically connected to a second connector terminal 322, which will be described later, are formed on a surface (surface at the −Z direction side) of the second circuit substrate 210.

A base end of the second circuit substrate 210 is supported by and fixed to a face of the wall body 81*b* on the +Y direction side. The second circuit substrate 210 is set to have a length such that an end thereof at the +Y direction side does not make contact with the rotational member 320. Therefore, the rotational member 320 can be freely rotationally moved from a state where the rotational member 320 is tilted with respect to the attachment direction at a predetermined angle to a state where the rotational member 320 is in parallel with the attachment direction.

The second connector terminal 322 is movably provided on a side face of the cartridge holder 80, which is in parallel with the attachment direction, and electrically connected with the first connector terminal 321. The second connector terminal 322 becomes to be in contact with the second circuit substrate 210 while the first connector terminal 321 moves from a position at which the first connector terminal 321 is separated from the first circuit substrate 300 to a position at which the first connector terminal 321 makes contact with the first circuit substrate 300 when the ink cartridge 90 is attached to the cartridge holder 80.

To be more specific, the second connector terminal 322 is provided on the other surface of the rotational substrate 323 (surface at the +Z direction) at the downstream side (at the −Y direction side) with respect to the supporting shaft 324 in the attachment direction. Second contact portions 322*a* which are electrically connected to the second electrode pads 210*a* of the second circuit substrate 210 are formed on a surface (surface at the +Z direction side) of the second connector terminal 322. The second contact portions 322*a* are provided at positions corresponding to the second electrode pads 210*a*. The heights of the second contact portions 322*a* are higher than the height of the second contact portion 122*a* according to the third embodiment. The heights of the second contact portions 322*a* indicate distances from a surface of the rotational member 320 to tops of the second contact portions 322*a*. The height of the second contact portion 122*a* indicates a distance from a surface of the rotational member 120 to a top of the second contact portion 122*a*. The second contact portions 322*a* make contact with the second circuit substrate 210 so that a posture of the rotational member 320 is held in a tilted state at a predetermined angle.

When the ink cartridge 90 is attached to the cartridge holder 80, the second connector terminal 322 rotationally operates from a state where a surface which makes contact with the second circuit substrate 210 is tilted with respect to the attachment direction (−Y direction) to a state where the surface is in parallel with the attachment direction.

The second connector terminal 322 is formed with an elastic metal material such as copper like the first connector terminal 321 and is arranged so as to correspond to the second electrode pads 210*a* of the second circuit substrate 210.

With such configuration, the second circuit substrate 210 functions as a stopper which holds a posture of the rotational member until the ink cartridge 90 is attached to the cartridge holder 80.

Figure 25A:
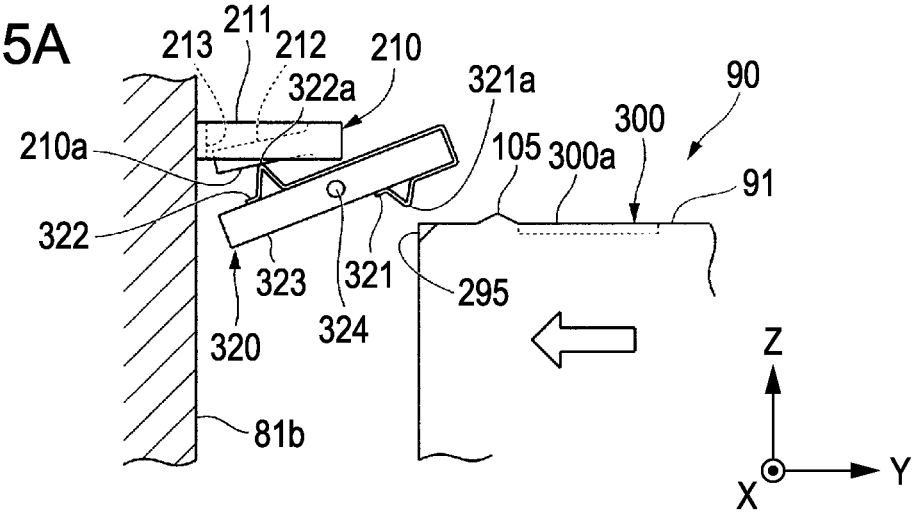
FIGS. 25A through 25C are schematic cross-sectional views illustrating a moving state of the connector terminal according to the fifth embodiment.
Figure 25B:
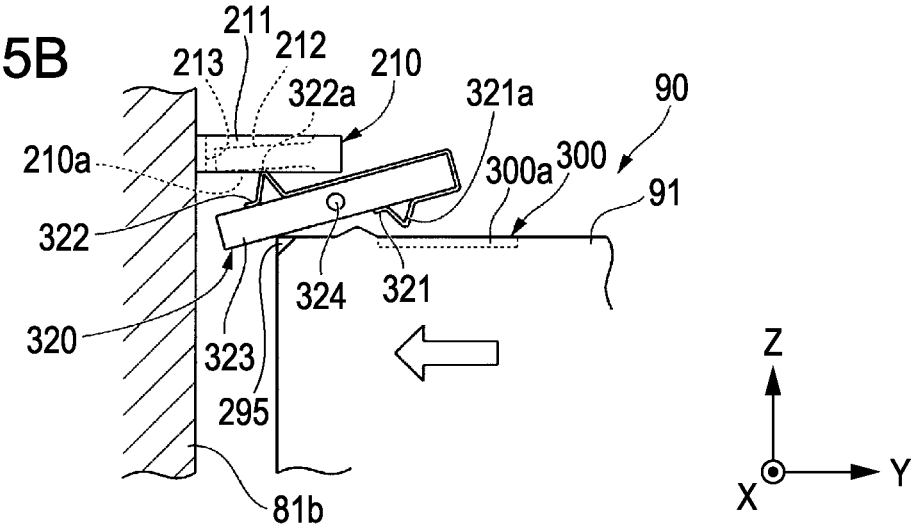
Figure 25C:
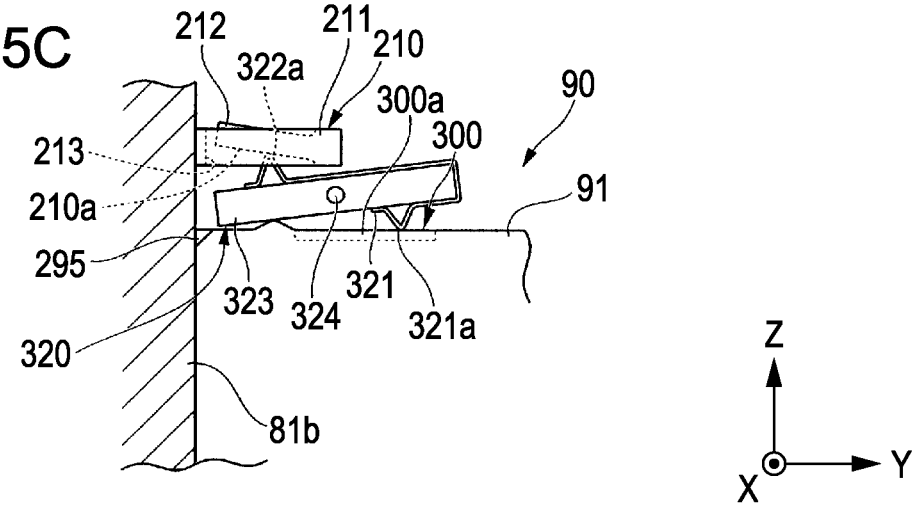

FIGS. 25A through 25C are schematic cross-sectional views illustrating moving states of the connector terminals 321, 322 according to the fifth embodiment. FIG. 25A is a view illustrating a state before the ink cartridge 90 is attached to the cartridge holder 80 and corresponds to FIG. 20A. FIG. 25B is a view illustrating a state when the ink cartridge 90 is being attached to the cartridge holder 80 and corresponds to FIG. 20B. FIG. 25C is a view illustrating a state after the ink cartridge 90 is completely attached to the cartridge holder 80 and corresponds to FIG. 20C.

When the ink cartridge 90 is attached to the cartridge holder 80, the first connector terminal 321 is moved from a position at which the first connector terminal 321 is separated from the first circuit substrate 300 to a position at which the first connector terminal 321 makes contact with the first circuit substrate 300. At the same time, the second connector terminal 322 is moved in a state where the second connector terminal 322 is in contact with the second circuit substrate 210. Moving states of the movement member 295 and the rotational member 320 will be described next.

At first, as illustrated in FIG. 25A, a state before the ink cartridge 90 is attached to the cartridge holder 80, that is, a state before the movement member 295 makes contact with the rotational member 320 is considered. In this case, the rotational member 320 is tilted with respect to the attachment direction at a predetermined angle. To be more specific, the second contact portions 322*a* are formed so as to make contact with the second circuit substrate 210 in a state where the rotational member 320 is tilted at a predetermined angle (heights of the second contact portions 322*a* become high). The stopper portion 212 is tilted to the −Z direction side. Therefore, a posture of the rotational member 320 is held by the stopper portion 212 of the second circuit substrate 210 in a state where an end thereof (end at the +Y direction side) ascends. The movement member 295 is positioned at the lower side (−Z direction side) with respect to the supporting shaft 324 of the rotational member 320. The projection portion 105 is separated from the first contact portion 321*a* of the first connector terminal 321 by a predetermined distance.

Next, as illustrated in FIG. 25B, a state when the ink cartridge 90 is being attached to the cartridge holder 80, that is, a state when the movement member 295 makes contact with the rotational member 320 to move the rotational member 320 is considered. The movement member 295 is positioned at a lower side (−Z direction side) with respect to the supporting shaft 324 of the rotational member 320 in a state before the ink cartridge 90 is attached to the cartridge holder 80. Therefore, if the movement member 295 makes contact with the rotational member 320 at the lower side and moves in the attachment direction, the rotational member 320 rotationally moves about the supporting shaft 324 in the clockwise direction. That is to say, the rotational member 320 rotationally moves from a state where the rotational member 320 is tilted with respect to the attachment direction at a predetermined angle to a state such that a gradient angle thereof becomes smaller.

The projection portion 105 is separated from the first contact portion 321*a* by a predetermined distance in a state before the ink cartridge 90 is attached to the cartridge holder 80. Therefore, the projection portion 105 does not make contact with any portions during the movement of the movement member 295. Further, the first contact portion 321*a* does not make contact with any portions until the first contact portion 321*a* makes contact with the first electrode pad 300*a*.

As illustrated in FIG. 25C, a state after the ink cartridge 90 is completely attached to the cartridge holder 80 is considered. In this case, the rotational member 320 is substantially in parallel with the attachment direction. At this time, the stopper portion 212 is in contact with the second contact portions 322*a* so as to be in a tilted state in the +Z direction side. That is, the first electrode pad 300*a* of the first circuit substrate 300 makes contact with the first contact portion 321*a* of the first connector terminal 321. The second electrode pads 210*a* of the second circuit substrate 210 are in contact with the second contact portions 322*a* of the second connector terminal 322 in advance. Therefore, a memory element 301 and a remaining amount detection sensor are electrically connected to a control circuit in the printer main body 2 through the first circuit substrate 300. This makes it possible to control operations of the memory element 301 and the remaining amount detection sensor from the side of the printer main body 2.

The entire disclosure of Japanese Patent Application Nos. 2010-034749, filed Feb. 19, 2010, 2010-036946, filed Feb. 23, 2010 are expressly incorporated by reference herein.

What is claimed is:

1. A liquid ejecting system comprising:

a liquid ejecting head which ejects liquid;

a container holder to which a liquid accommodating container main body is detachably attached;

a connector terminal which is attached to a side face of the container holder, which is in parallel with an attachment direction of the liquid accommodating container main body; and a movement member which is provided in the container holder and moves a circuit substrate on the liquid accommodating container main body by contacting the circuit substrate, which is movably provided on a side face along the attachment direction of the liquid accommodating container main body, from a position at which the circuit substrate is separated from the connector terminal in a direction that intersects the attachment direction to a position at which the circuit substrate makes contact with the connector terminal when the liquid accommodating container main body is attached to the container holder.

2. The liquid ejecting system according to claim 1, wherein the movement member is a position restriction pin which restricts a position of the liquid accommodating container main body.

3. The liquid ejecting system according to claim 2, wherein the position restriction pin includes a convex portion which makes contact with the circuit substrate when the liquid accommodating container main body is attached to the container holder, and the liquid accommodating container main body includes a position restriction hole into which the position restriction pin is inserted and the position restriction hole includes a concave portion corresponding to the convex portion.

4. The liquid ejecting system according to claim 1, wherein the circuit substrate rotationally operates from a state where a surface which makes contact with the connector terminal is tilted with respect to the attachment direction to a state where the surface is in parallel with the attachment direction when the liquid accommodating container main body is attached to the container holder.

5. A liquid ejecting system comprising:

a liquid ejecting head which ejects liquid;

a liquid accommodating container main body which accommodates the liquid;

a container holder to which the liquid accommodating container main body is detachably attached;

a first circuit substrate which is fixed to a side face along an attachment direction of the liquid accommodating container main body;

a first connector terminal which is movably provided on a side face of the container holder, which is in parallel with the attachment direction; and a movement member which is provided in the liquid accommodating container main body at a downstream side of the first circuit substrate in the attachment direction and moves the first connector terminal by contacting the first connector terminal from a position at which the first connector terminal is separated from the first circuit substrate in a direction that intersects the attachment direction to a position at which the first connector terminal makes contact with the first circuit substrate when the liquid accommodating container main body is attached to the container holder.

6. The liquid ejecting system according to claim 5, wherein the first connector terminal rotationally operates from a state where a surface which makes contact with the first circuit substrate is tilted with respect to the attachment direction to a state where the surface is in parallel with the attachment direction when the liquid accommodating container main body is attached to the container holder.

7. The liquid ejecting system according to claim 5, wherein the first connector terminal includes a plurality of contact portions each of which is arranged at a position which is different from each other in the attachment direction.

8. The liquid ejecting system according to claim 5, further including:

a second circuit substrate which is fixed to a side face of the container holder, which is in parallel with the attachment direction; and a second connector terminal which is movably provided on a side face of the container holder, which is in parallel with the attachment direction, and electrically connected with the first connector terminal, wherein the second connector terminal moves from a position at which the second connector terminal is separated from the second circuit substrate to a position at which the second connector terminal makes contact with the second circuit substrate when the first connector terminal moves from the position at which the first connector terminal is separated from the first circuit substrate to the position at which the first connector terminal makes contact with the first circuit substrate when the liquid accommodating container main body is attached to the container holder.

9. A liquid accommodating container comprising:

a liquid accommodating container main body which accommodates liquid; and a circuit substrate which is movably provided on a side face of the liquid accommodating container main body and moves on the liquid accommodating container main body in a direction for being separated from the liquid accommodating container main body when the liquid accommodating container main body is attached to a container holder to which the liquid accommodating container main body is attached.

10. A liquid accommodating container comprising:

a liquid accommodating container main body which accommodates liquid;

a first circuit substrate which is fixed to a side face of the liquid accommodating container main body; and a movement member which is provided at a downstream side of the first circuit substrate in an attachment direction of the liquid accommodating container main body in the liquid accommodating container main body and moves a first connector terminal provided in a container holder to which the liquid accommodating container main body is attached contacting the first connector terminal from a position at which the first connector terminal is separated from the first circuit substrate to a position at which the first connector terminal makes contact with the first circuit substrate when the liquid accommodating container main body is attached to the container holder.

* * * * *